US005976418A

United States Patent [19]

Fuller et al.

[11] Patent Number: 5,976,418

[45] Date of Patent: Nov. 2, 1999

[54] CONDUCTING COMPOSITIONS

[75] Inventors: Timothy J. Fuller, Pittsford; Damodar M. Pai, Fairport; John F. Yanus, Webster; Paul J. DeFeo, Sodus Point; Markus R. Silvestri, Fairport; Ram S. Narang, Macedon; William W. Limburg, Penfield; Dale S. Renfer, Webster; Milan Stolka, Fairport; Martin A. Abkowitz, Webster; Ralph A. Mosher, Rochester, all of N.Y.

[73] Assignee: Xerox Corporation, Stamford, Conn.

[21] Appl. No.: 09/186,542

[22] Filed: Nov. 5, 1998

[51] Int. Cl.[6] ..... H01B 1/00; H01B 1/12; H01B 1/20; B05D 5/12

[52] U.S. Cl. ..... 252/500; 252/510; 252/511; 427/385.5; 427/58; 427/393.1

[58] Field of Search ..... 252/510, 511, 252/500; 430/56, 59, 66, 96; 528/125, 126, 176, 185, 190, 397, 503; 525/390, 437; 524/765, 779; 427/385.5, 58, 393.1

[56] References Cited

U.S. PATENT DOCUMENTS

| | | | |
|---|---|---|---|
| 4,338,222 | 7/1982 | Limburg et al. | 252/500 |
| 4,801,517 | 1/1989 | Frechet et al. | 430/59 |
| 4,806,443 | 2/1989 | Yanus et al. | 430/56 |
| 4,806,444 | 2/1989 | Yanus et al. | 430/56 |
| 5,300,339 | 4/1994 | Hays et al. | 428/36.9 |
| 5,386,277 | 1/1995 | Hays et al. | 355/259 |
| 5,549,851 | 8/1996 | Fukushima et al. | 252/519 |
| 5,587,224 | 12/1996 | Hsieh et al. | 428/195 |
| 5,739,254 | 4/1998 | Fuller et al. | 528/125 |

*Primary Examiner*—Mark Kopec
*Assistant Examiner*—Derrick G. Hamlin

[57] ABSTRACT

A conductive polymer composition selected from the group consisting of a first composition including
- a polymer containing halomethylated aromatic groups, and
- a charge transporting material selected from the group consisting of
  - at least one charge transport monomer containing arylamine groups,
  - at least one charge transport polymer containing arylamine units in the main polymer chain,
  - and mixtures thereof, and a second composition including
- at least one monomer containing a halomethylated aromatic group,
- at least one charge transport monomer containing arylamine groups and
- a polymer binder, and a third composition including:
- at least one monomer containing a halomethylated aromatic group, and
- at least one charge transport polymer with arylamine units in the main polymer chain.

The aforementioned compositions may be applied as coatings and used in high speed laser printing and related printing processes. These conductive polymeric compositions and processes therefor provide improved stability and a broad range of conductivities, manufacturing and compositional latitude, and dielectric strength.

18 Claims, No Drawings

CONDUCTING COMPOSITIONS

BACKGROUND OF THE INVENTION

The present invention relates in general to conductive polymeric coating compositions having controllable, reproducible, and stable electrical conductivity. These compositions may be employed in many applications including, for example, electrophotographic image development systems.

Electrophotographic image development systems such as liquid image development systems, scavengeless development systems and hybrid scavengeless development systems are well known in the art of electrophotography. Scavengeless development systems do not scavenge or interact with a previously toned image and thereby do not negatively affect image quality and are important in trilevel and highlight color xerography, reference for example, U.S. Pat. No. 4,078,929.

Two-phase conductive compositions are also known and contain, for example, dispersions of conductive particles, such as carbon black or graphite, in an insulating polymer matrix, for example, dielectric binders such as a phenolic resin or fluoropolymer. The conductive pigment loading concentration of two-phase conductive compositions are near the percolation threshold concentration. Conductive particle concentration levels at or near the percolation limit allow for conductive particle contact, resulting in a burst of conductivity, reference for example, U.S. Pat. No. 4,505,573, to Brewington et al. The dielectric constant of conductive coatings and overcoatings typically can be from about 3 to about 5, and preferably about 3. The desired conductivity is achieved by controlling the loading of the conductive particles. However, the low conductivity values required for electrophotographic image development systems and the large, intrinsic electrical conductivity of carbon black make it extremely difficult to achieve predictable and reproducible conductivity values. Very small changes in the loading of conductive particles near the percolation threshold can cause dramatic changes in the conductivity of a coating. Furthermore, even at a constant weight loading, differences in particle size and shape can cause wide variations in conductivity. Moreover, the percolation threshold approach to obtaining conductive coatings requires relatively high concentrations of conductive particles. At these concentrations, the coatings typically become brittle, and the mechanical properties of the coating are controlled by carbon black content rather than by the polymer matrix.

Another approach is to molecularly dope a polymer matrix with mixtures of a neutral charge transport molecule and its radical cation or anion. "Molecular doping" refers to the relatively low amounts of dopant added, compared to the aforementioned high loading concentrations of carbon black dispersions, to increase the conductivity of a polymer matrix. The resulting molecularly doped mixture is essentially a solid solution. No chemical bonding occurs between the dopant and the charge transport molecule so as to produce a new material or alloy. The doped polymer provides stable and controlled conductivity arising from molecular doping with dopants such as oxidizing agents. In the presence of an oxidizing dopant, partially oxidized charge transport moieties in the charge-transporting polymer act as hole carrier sites, which transport positive charges or "holes" through the unoxidized charge transport molecules. For example, Mort et al., *J. Electronic Materials,* 9:41 (1980), disclose the possibility of chemically controlling dark conductivity by co-doping a polycarbonate with neutral and oxidized species of the same molecule, tri-p-tolylamine (TTA), that is TTA, and $TTA^+$ respectively, where $TTA^+$ represents a cation radical salt of TTA. Limburg et al., in U.S. Pat. No. 4,338,222, disclose an electrically conducting, three-component composition comprising: a polymer matrix; an organic hole transport compound, particularly tetraaryl biphenyl diamines, and oxidized species of the same molecule, which is the reaction product of the organic hole transport compound and an oxidizing agent capable of accepting one electron from the hole transport compound. Hays et al., in U.S. Pat. No. 5,300,339 and U.S. Pat. No. 5,448,342, disclose an overcoating comprising at least three constituents: a charge transport compound, for example, especially an aryl diamine, a polymer binder, especially a polycarbonate or a polyethercarbonate, and an oxidizing agent. Hays et al., in U.S. Pat. No. 5,386,277, further disclose an overcoating comprising two constituents: a charge transport polymer with tetraaryl biphenyldiamine units in the main chain and an oxidant.

INFORMATION DISCLOSURE STATEMENT

U.S. Pat. No. 4,338,222 to Limburg et al., issued Jul. 6, 1982—An electrically conducting composition is disclosed comprising an organic hole transporting compound and the reaction product of an organic hole transporting compound and an oxidizing agent capable of accepting one electron from the hole transporting compound. This composition can have three-components including a polymer matrix; an organic hole transport compound, particularly tetraaryl biphenyldiamines, and oxidized species of the same molecule, which is the reaction product of the organic hole transport compound and an oxidizing agent capable of accepting one electron from the hole transport compound.

U.S. Pat. No. 4,806,443 to Limburg et al., issued Feb. 21, 1989—An electrostatographic imaging member is disclosed in which the imaging member comprises a substrate and an electroconductive layer, the imaging member comprising a polymeric arylamine compound. The polymeric arylamine compound is a reaction product of a specific glycol chlroformate and a specific dihydroxy arylamine compound.

U.S. Pat. No. 4,806,444 to Yanus et al., issued Feb. 21, 1989—An electrostatographic imaging member is disclosed in which the imaging member comprises a substrate and an electroconductive layer, the imaging member comprising a polymeric arylamine compound.

U.S. Pat. No. 4,801,517 to Frechet et al., issued Jan. 31, 1989—An electrostatographic imaging member is disclosed in which the imaging member comprises a substrate and an electroconductive layer, the imaging member comprising a polymeric arylamine compound.

U.S. Pat. No. 5,300,339 to Hays et al., issued Apr. 5, 1994—A coated toner transport roll is disclosed containing a core with a coating thereover of transporting molecules dispersed in a binder and an oxidizing agent selected from the group consisting of ferric chloride and trifluoroacetic acid. These oxidizing agents can be selected in an amount of from about 1 to about 50 weight percent. Also, the coating possesses a relaxation time of from about 0.0099 millisecond to about 3.5 milliseconds, and a residual voltage of from about 1 to about 10 volts.

U.S. Pat. No. 5,386,277 to Hays et al. issued Jan. 31, 1995—An apparatus is disclosed for developing a latent image that contains a housing with a supply of a developer of carrier and toner and a coated toner donor member, which member is spaced from the surface on which a latent image is being recorded. The apparatus also includes a means for advancing the developer material in the chamber of the housing and this means cooperates with the donor means and both means define a region wherein a substantially constant quantity of toner is deposited on the donor member. The apparatus further includes an electrode means positioned near the surface of a dielectric core roll and these electrodes are biased to detach toner from the donor member and to form a donor cloud for developing the latent image. The coated toner transport means can be comprised of a core with a coating of an oxidized polyether carbonate, e.g. a charge transport polymer with tetraaryl diamine units in the main chain and an oxidant.

U.S. Pat. No. 5,739,254 to Crandall et al., issued on Apr. 14, 1998 and U.S. Pat. No. 5,753,783 to Crandall et al., issued on May 19, 1998—A process is disclosed which comprises reacting a polymer of the general formula

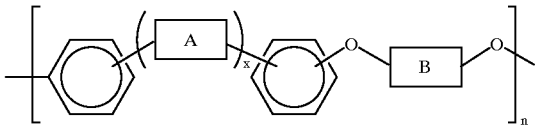

or

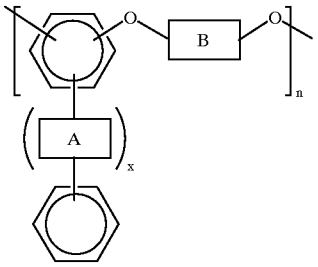

wherein x is an integer of 0 or 1, A is one of several specified groups, such as

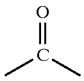

B is one of several specified groups, such as

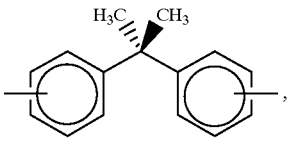

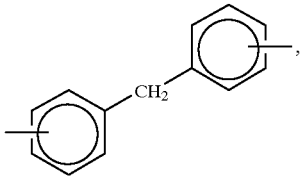

-continued

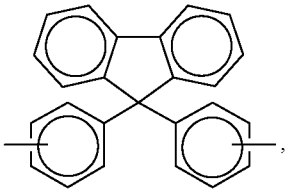

or mixtures thereof, and n is an integer representing the number of repeating monomer units, with an acetyl halide and dimethoxymethane in the presence of a halogen-containing Lewis acid catalyst and methanol, thereby forming a haloalkylated polymer. In a specific embodiment, the haloalkylated polymer is then reacted further to replace at least some of the haloalkyl groups with photosensitivity-imparting groups. Also disclosed is a process for preparing a thermal ink jet printhead with the aforementioned polymer.

U.S. Pat. No. 5,549,851, to Fukushima et al., issued Aug. 27, 1996—Disclosed is silicon containing polymer such as a polysilane, poly(disilanylenephenylene), and poly (disilanyleneethynylene) is admixed with an amine compound and then doped with an oxidizing dopant, typically iodine and ferric chloride, to produce a highly conductive polymer composition having improved shapability. The composition is easily applicable, as by spin coating, to form a highly conductive film or coating. The conductive coating can have three constituents: an aryl amine charge transport molecule, polysilane binder, and an oxidant. However, it is known that polysilane binders decompose upon light exposure. It is also particularly difficult to prepare thick coating films of polysilanes, for example, about 30 micron. Representative coatings were found to be unstable electrically and mechanically under ambient condition, for example, ferric chloride doped coatings were very brittle with unstable conductivity.

U.S. Pat. No. 5,587,224, to Hsieh et al., issued Dec. 24, 1996—A coated donor roll is disclosed comprised of a core with a coating thereover comprised of a photolysis reaction product of a charge transporting polymer and a photo acid compound. Included in the disclosure is the use of photoacids as photooxidants for overcoating with two or three constituents.

CROSS REFERENCE TO COPENDING APPLICATION

This application is related to the following US-A patent application:

U.S. patent application Ser. No. 08/950,303 filed in the names of Hsieh et al. on Oct. 14, 1998 (Attorney Docket No. D/97457)—A conductive coating is disclosed comprising an oxidized oligomer salt, a charge transport component, and a polymer binder, for example, a conductive coating comprising an oxidized tetratolyldiamine salt of the formula

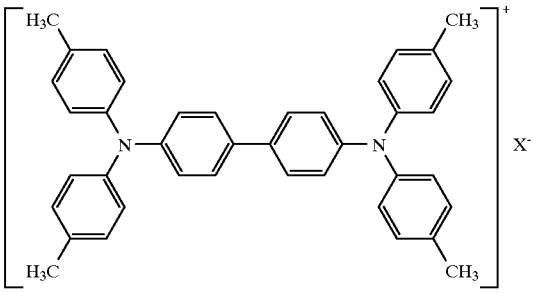

a charge transport component, and a polymer binder, wherein $X^-$ is a monovalent anion.

The entire disclosures of each of the aforementioned patents and the pending application are incorporated herein by reference.

Thus, there continues to be a need for novel methods of creating conductive compositions.

There also continues to be a need for conductive polymeric compositions and processes which provide coatings with wide range of stable and controlled conductivity.

There further remains a need for conductive polymeric compositions which are homogeneous and pinhole free.

There additionally remains a need for conductive polymeric compositions which are suitable for use in high speed printing systems.

Also, there has been sought an inexpensive, efficient and environmentally efficacious means for producing conductive polymeric compositions.

These needs and others solutions to the aforementioned problems are provided for in embodiments of the present invention and as illustrated herein.

SUMMARY OF THE INVENTION

It is, therefore, an object of the present invention to provide improved compositions with improved conductivity and stability properties which overcome the above-noted disadvantages.

It is another object of the present invention to provide improved compositions for overcoming, or minimizing deficiencies of prior art compositions and processes, by providing compositions with improved conductivity and stability properties.

It is still another object of the present invention to provide conductive coatings with stable conductivity under a wide range of environmental conditions.

It is yet object of the present invention to provide conductive coatings with controlled and reproducible conductivity in the range of 100.0 S/cm to $10^{-12}$ S/cm.

It is another object of the present invention to provide homogeneous molecular conductive coatings with controlled conductivity that is not limited by percolation.

It is still another object of the present invention to provide a simple manufacturing process for the conductive coatings.

It is yet object of the present invention to provide a process with broad manufacturing latitude, such as compatibility with a wide range of solvents and polymer binders.

It is another object of the present invention to provide pinhole free conductive coatings with high dielectric strength.

It is still another object of the present invention to provide conductive coatings with high mechanical stability and wear resistance.

It is yet object of the present invention to provide conductive coatings with low surface energy.

It is another object of the present invention to provide conductive coatings that can protect metal substrates from oxidation or corrosion.

It is still another object of the present invention to provide conductive coatings with controlled conductivity for numerous semiconductor device applications.

The foregoing and others are accomplished in accordance with the present invention by providing a conductive polymer composition selected from the group consisting of

- a first composition comprising
  - a polymer containing halomethylated aromatic groups, and
  - a charge transporting material selected from the group consisting of
    - at least one charge transport monomer containing arylamine groups,
    - at least one charge transport polymer containing arylamine units in the main polymer chain,
    - and mixtures thereof, and
- a second composition comprising
  - at least one monomer containing a halomethylated aromatic group,
  - at least one charge transport monomer containing arylamine groups and
  - a polymer binder, and
- a third composition comprising:
  - at least one monomer containing a halomethylated aromatic group, and
  - at least one charge transport polymer with arylamine units in the main polymer chain.

Still other embodiments of the present invention include applying the aforementioned compositions and processes for high speed laser printing and related printing processes. The conductive polymeric compositions and processes thereof of the present invention, in embodiments, provide improved stability and a broad range of conductivities, manufacturing and compositional latitude, and dielectric strength.

The conductive polymeric coating compositions of the present invention have controllable, reproducible, and stable electrical conductivity. This conductivity can for example, be in the range of between about 1 to about $10^{-12}$ S/cm or $(\text{ohm-cm})^{-1}$. Coating compositions of the present invention with an electrical conductivity in the range of $10^{-8}$ to $10^{-10}$ S/cm are useful anti-static materials or charge relaxation materials which have application, for example, in electrophotographic image development systems such as liquid image development systems or scavengeless and hybrid scavengeless development systems. Coating compositions of the present invention having electrical conductivities in the range of about 1 to about $10^{-10}$ S/cm are also useful in various applications such as: thin film transistor devices, see Dodabalapur et al., U.S. Pat. No. 5,574,291, and Tsumura; A. et al., U.S. Pat. No. 5,500,537; in electroluminescent devices, EP 686662-A2, U.S. Pat. No. 5,514,878 and U.S. Pat. No. 5,609,970, and A. J. Heeger, "Self-assembled Networks of Conducting polyaniline" in *Trends in Polymer Science,* 3, 39–47, 1995); in liquid crystal displays, U.S. Pat. No. 5,619,357 and U.S. Pat. No. 5,498,762; in electrochromic devices, U.S. Pat. No. 5,500,759, and U.S. Pat. No. 5,413,739; in photochromic devices, U.S. Pat. No. 5,604,626; in rechargeable batteries, U.S. Pat. No. 4,987,042 and U.S. Pat. No. 4,959,430; in secondary cells, U.S. Pat. No. 5,462,566 and U.S. Pat. No. 5,460,905; in electrochemical capacitors, U.S. Pat. No. 5,527,640, U.S. Pat. No. 4,910,645, U.S. Pat. No. 5,442,197 and U.S. Pat. No. 5,626,729; in photovoltaic cells, U.S. Pat. No. 5,482,570; in photodetectors, U.S. Pat. No. 5,523,555; in photosensitive imaging member, U.S. Pat. No. 5,616,440 and U.S. Pat. No. 5,389,477; in photographic coatings, U.S. Pat. No. 5,443,944; in formation of conductive polymer patterns, U.S. Pat. No. 5,561,030; in electroplating, U.S. Pat. No. 5,415,762, U.S. Pat. No. 5,575,898 and U.S. Pat. No. 5,403,467; in laser applications, Katulin, V. A. et al., *Sov. J. Quantum Electron.,* 14, 74–77 (1984), Hide et al., *Science* 273, 1833, (1996); and Tessler, et al., *Nature,* 382, 695 (1996); in polymer grid triodes, U.S. Pat. No. 5,563,424; in anticorrosion coatings, U.S. Pat. No. 5,532,025 and U.S. Pat. No. 5,441,772; in ferromagnetic or high magnetic spin coatings, Shiomi et al., *Synthetic Metals,* 85, 1721–1722 (1997), and references cited therein.

In various embodiments, the present invention provides a composition for use as conductive coatings comprising an oxidizing agent containing a halomethylated aryl group. The halomethylated aryl group can be attached to a monomer or a polymer. The polymer containing halomethylated aromatic groups is represented by the formula:

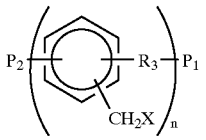

wherein $P_1$ and $P_2$ are polymers, $R_3$ is selected from the group consisting of substituted or unsubstituted arylene, alkylene or arylene alkyl containing from 1 to 20 carbon atoms in the alkylene and arylene group, X is selected from the group consisting of Cl, Br or l, and n is >1.

$P_1$ and $P_2$ may be any suitable polymer. Typical polymers include, polyphenylene, polystyrene, polycarbonate, polyarylene ether ketones, and the like.

Where the halomethylated aryl group is attached to a monomer, it can be represented by the formula:

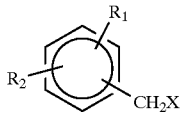

wherein $R_1$ and $R_2$ are selected from the group consisting of arylene, alkylene or arylene alkyl containing from 1 to 20 carbon atoms in the alkylene and arylene groups, and X is selected from the group consisting of Cl, Br and l.

Preferred halomethylated aryl group containing monomers and polymers include, for example:

poly(arylene ether ketone) represented by the formula:

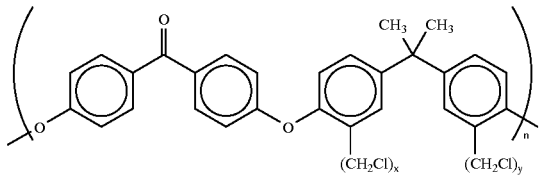

wherein

0<x<1,

0<y<1 and n is >1;

acryloxy-chloromethylated poly(arylene ether ketone) represented by the formula:

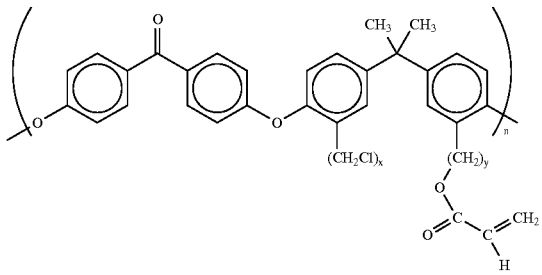

wherein

0<x<1,

0<y<1 and n is >1;

chloromethylated polystyrene represented by the formula:

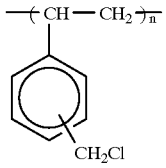

wherein n is >1;

chloromethylated polyether ketone represented by the formula:

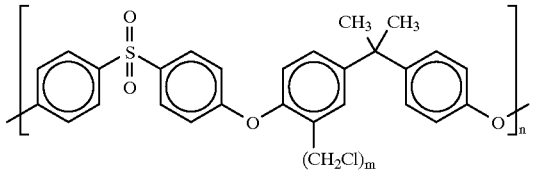

wherein n is >1 and 0<m<1;

chloromethylated polycarbonate represented by the formula:

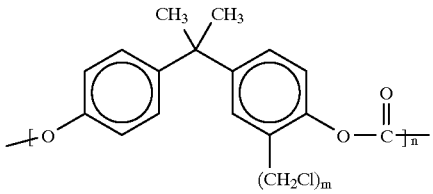

wherein n is >1 and 0<m<1;

chloromethylated polyarylene ether represented by the formula:

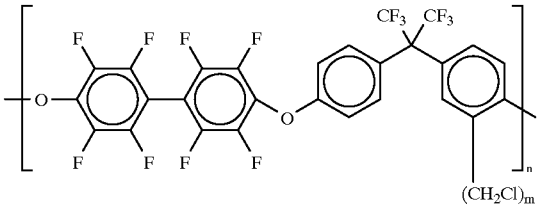

wherein n is >1 and 0<m<1;

chloromethylated poly(benzophenone-bisphenylfluorenone) represented by the formula:

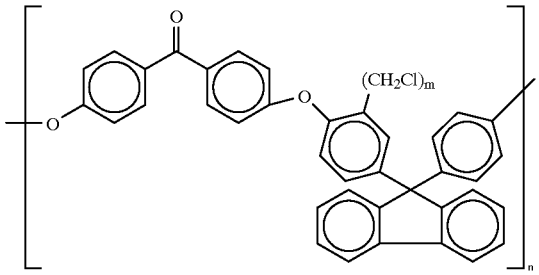

wherein:

n is >1 and 0<m<1.

Another component of some embodiments of the conducting compositions of this invention are charge transport monomers containing arylamine groups. The monomers containing arylamine charge transport groups are represented by the formula:

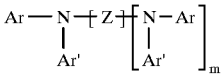

wherein m is 0 or 1,

Z is selected from the group consisting of:

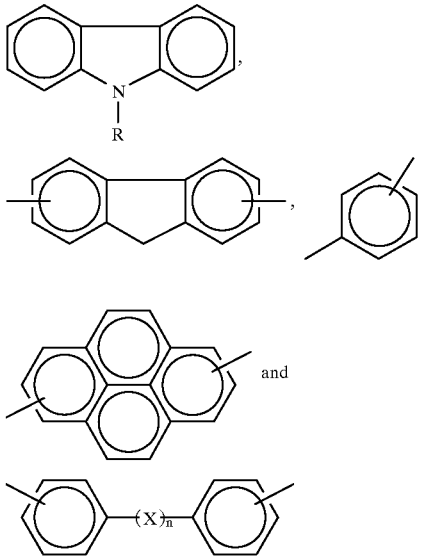

n is 0 or 1,

Ar is selected from the group consisting of:

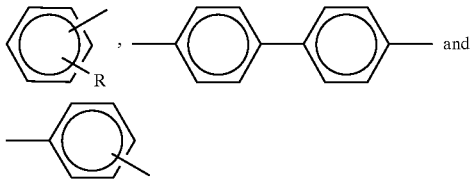

R is selected from the group consisting of —$CH_3$, —$C_2H_5$, —$C_3H_7$, and —$C_4H_9$, Ar' is selected from the group consisting of:

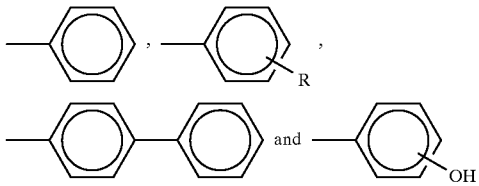

X is selected from the group consisting of:

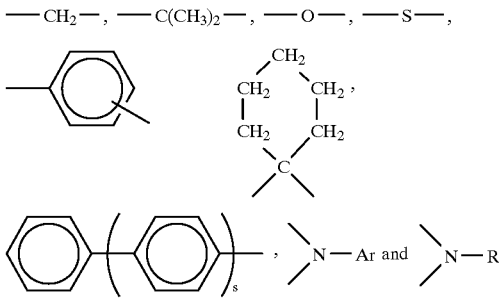

s is 0, 1 or 2.

Examples of monomers containing arylamine charge transport units for admixing with halomethylated aryl group containing monomers or polymers include, N, N'-bis (alkylphenyl)-[1,1'-biphenyl]-4,4'-diamine wherein the alkyl is, for example, methyl, ethyl, propyl, n-butyl etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine and the like.

Polymers containing charge transport polymer containing aryl amine units in the main polymer chain are represented by the formula:

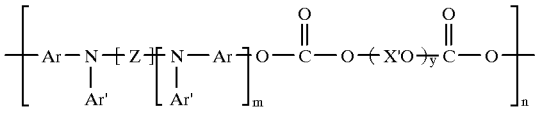

wherein:

m is 0 or 1, n is between about 5 and about 5000,

Z is selected from the group consisting of:

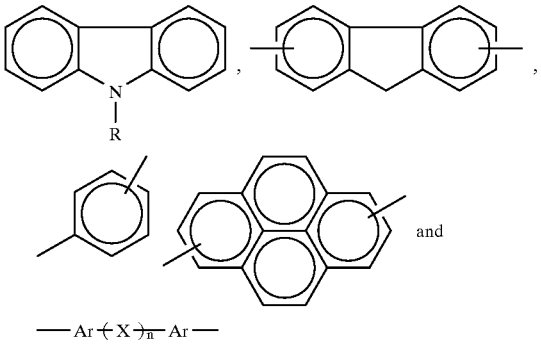

n is 0 or 1,

R is an alkyl radical selected from the group consisting of alkyl or iso-alkyl groups containing 2 to 10 carbon atoms, Ar' is selected from the group consisting of:

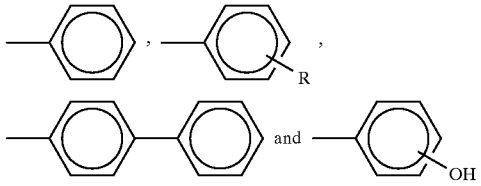

X is selected from the group consisting of:

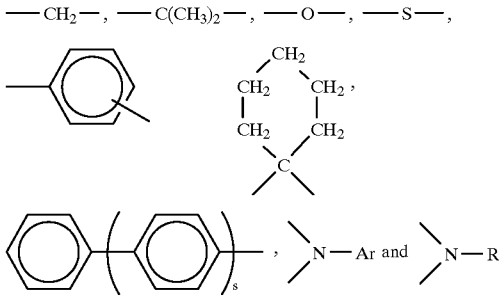

s is 0, 1 or 2,

X' is an alkylene radical selected from the group consisting of alkylene and iso-alkylene groups containing 2 to 10 carbon atoms, and Y is 1, 2 or 3.

A typical charge transport polymer containing aryl amine units in the main polymer chain represented by the above formula includes:

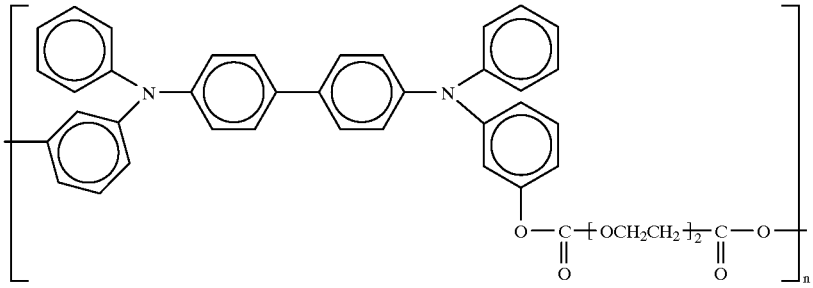

wherein the value of n is between about 10 and about 1000. These and other charge transporting arylamine containing polymers represented by the above generic formula are described in U.S. Pat. No. 4,806,443, the entire disclosure thereof being incorporated herein by reference.

Ar is selected from the group consisting of:

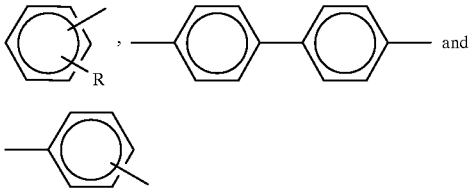

Other typical charge transporting polymers containing aryl amine units in the main polymer chain include arylamine compounds represented by the formula:

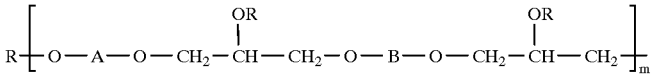

wherein:

R is selected from the group consisting of —H, —$CH_3$, and —$C_2H_5$, m is between about 4 and about 1,000; and A is an arylamine group represented by the formula:

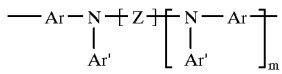

wherein:

m is 0 or 1,

Z is selected from the group consisting of:

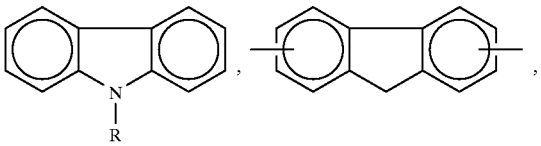

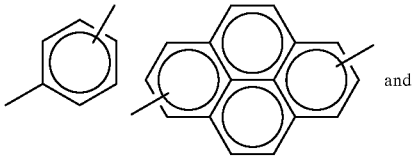

n is 0 or 1,

Ar is selected from the group consisting of:

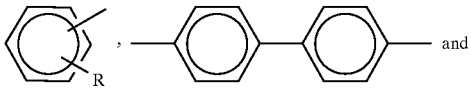

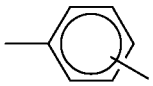

wherein:

R is selected from the group consisting of —$CH_3$, —$C_2H_5$, —$C_3H_7$, and —$C_4H_9$, Ar' is selected from the group consisting of:

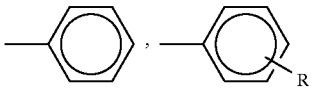

-continued

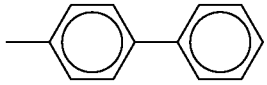

X is selected from the group consisting of:

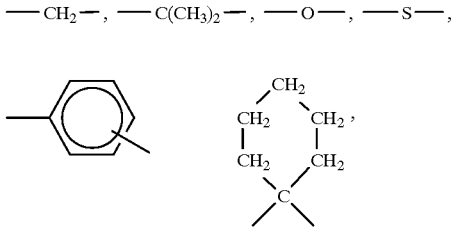

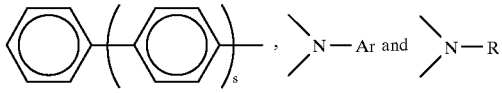

B is selected from the group consisting of:

the arylamine group as defined for A, and an arylamine group represented by the formula:

wherein

Ar is as defined above, and

V is selected from the group consisting of:

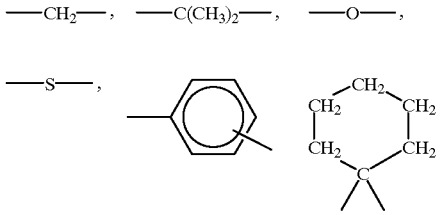

and n is 0 or 1.

Typical examples of charge transporting polymers containing aryl amine units in the main polymer chain represented by the above include:

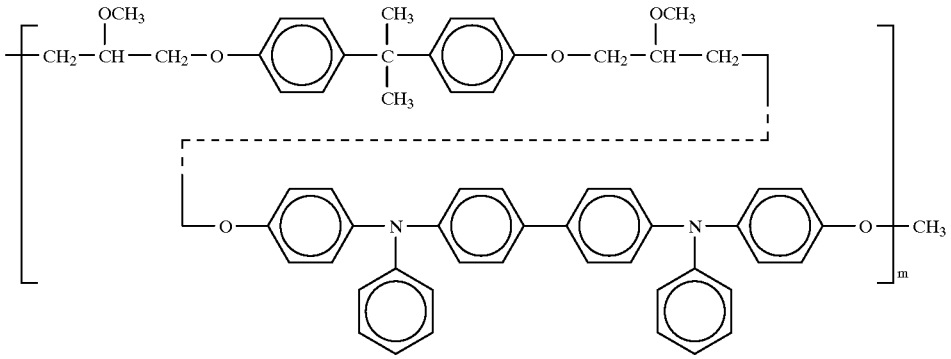

wherein the value of m was between about 18 and about 19, and

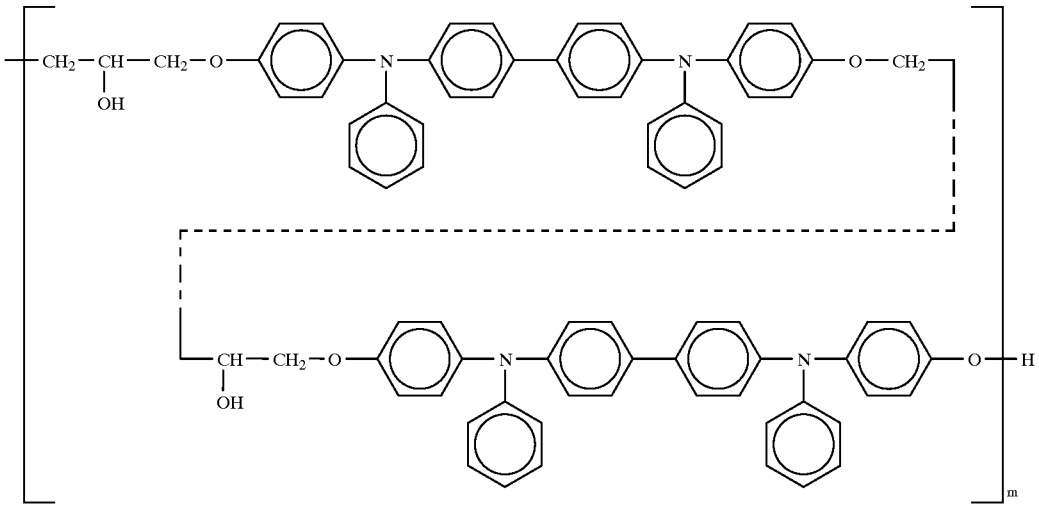

wherein the value of m was between 4 and 5.

These and other charge transporting polymers represented by the above generic formula are described in U.S. Pat. No. 4,818,650 and U.S. Pat. No. 4,956,440, the entire disclosures thereof being incorporated herein by reference.

An example of still other charge transporting polymers typical charge transporting polymers containing aryl amine units in the main polymer chain include arylamine compounds represented by the formula:

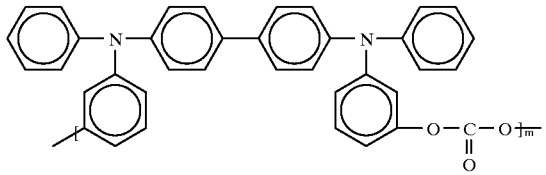

wherein the value of m is between about 10 and about 50. This and other related charge transporting polymers are described in U.S. Pat. No. 4,806,444 and U.S. Pat. No. 4,956,487, the entire disclosures thereof being incorporated herein by reference.

Other examples of typical charge transporting polymers containing arylamine units in the main polymer chain include:

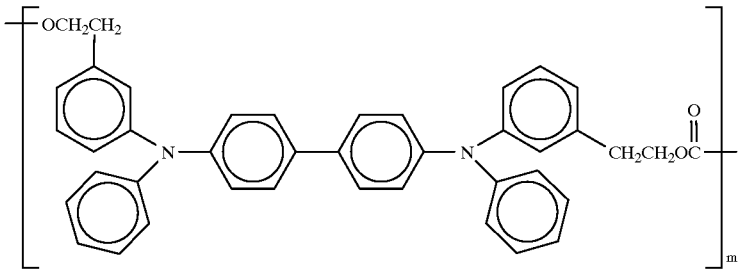

wherein m is between about 10 and about 10,000, and

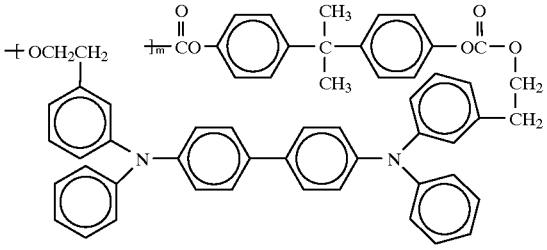

wherein m is between about 10 and about 1,000. Related charge transporting polymers include copoly [3,3'bis(hydroxyethyl)triphenylamine/bisphenol A]carbonate, copoly [3,3'bis(hydroxyethyl) triphenylbenzidine/bisphenol A]carbonate, poly [3,3'bis (hydroxyethyl)triphenylamine/bisphenol A]carbonate, poly [3,3'bis(hydroxyethyl)triphenylbenzidine/bisphenol A]carbonate, an the like. These charge transporting polymers are described in U.S. Pat. No. 4,401,517, the entire disclosure thereof being incorporated herein by reference.

Further examples of typical charge transporting polymers containing aryl amine units in the main polymer chain include:

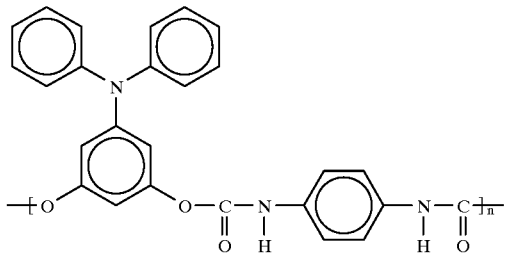

wherein n is between about 5 and about 5,000; and

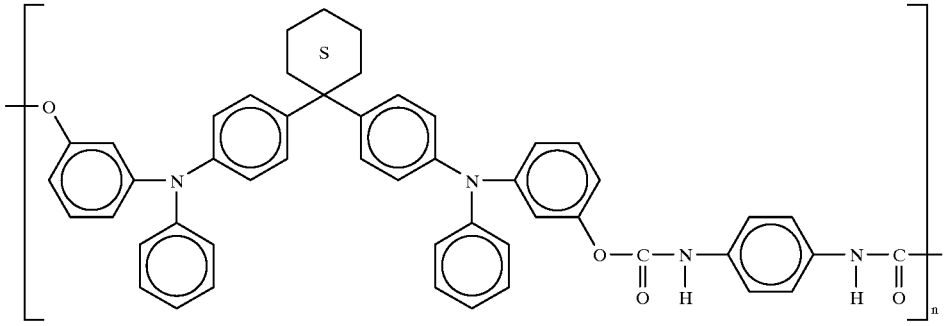

wherein n represents a number sufficient to achieve a weight average molecular weight between about 20,000 and about 500,000.

The compositions of this invention can be prepared in a plurality of different combinations:

(1) A polymer or a combination of polymers containing halomethylated aromatic group in combination with a charge transport monomer or combination of charge transport monomers containing arylamine group, (2) A polymer or a combination of polymers containing halomethylated aromatic group in combination with a charge transport polymer or combination of charge transport polymers containing arylamine units in the polymer chain, (3) a monomer or a combination of monomers containing halomethylated aromatic group in combination with a charge transport monomer or a combination of charge transport monomers containing arylamine groups and a film forming binder, (4) a monomer or a combination of monomers containing halomethylated aromatic group in combination with a polymer or a combination of charge transport polymers containing arylamine units in the polymer chain.

It is believed that an electron is transferred from the arylamine moiety of the charge transport monomer or the charge transport polymer to the halomethylated aryl group forming either a charge transfer complex or free carriers.

Prior art use of acids or photoacids creates radical cations of arylamines to create controlled conductivity films. Radical cations are thermally unstable and susceptible to environmental conditions. The blended polymeric charge transfer complexes of this invention are heat and humidity insensitive. Without being limited by theory, the conductivity can be controlled or tuned by varying the concentration of chloromethylated groups and or concentration of the arylamine moiety. If both the halomethylated aromatic groups and arylamine moiety are attached to small (monomer) molecules rather than being part of film forming polymers, a binder is required to enable formation of continuous dried coatings. Typical organic polymeric film forming binders include thermoplastic and thermosetting resins such as, but not limited to, polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers and polymer blends thereof.

In the various embodiments of this invention, the weight percent ratio of the monomer or polymer containing halomethylated aromatic group to the monomer or polymer containing arylamine moiety is of from about 0.01:99.99 to about 99.99:0.01. If a polymeric binder free of arylamine and halomethylated aromatic groups is required to form a film, the weight percent ratio of the monomer containing halomethylated aromatic group plus the monomer containing arylamine moiety to the polymer binder is from about 10:90 to about 90:10.

Any suitable solvent may be utilized to dissolve the conducting coating composition. The solvent should dissolve all of the composition components selected. Typical solvents include, for example, methylene chloride, tetrahydrofuran, monochlorobenzene, toluene, and the like. Preferably, the solids concentration of the coating solution is from about 0.1 to about 50 weight percent, based on the total weight of the coating solution.

Any suitable and conventional technique may be utilized to mix and therefore apply the conducting layer coating mixture. Typical application techniques, for example, spin coating, spray coating, dip coating, flow coating roll coating, wire wound rod coating and the like. Removing of the solvent of a solvent coated layer may be effected by any suitable conventional technique such as oven drying, infrared radiation drying, air drying and the like.

Embodiments of the conductive polymeric compositions of the present invention can form coatings having a conductivity range of, for example, from about $10^{-12}$ to about 1 S/cm, the conductivity depending on the concentration of the chloromethyl groups and the concentration of the arylamine groups selected.

In another embodiment of the present invention, a process is provided for fabricating conductive polymer coatings comprising:

providing a substrate, preparing a coating solution of a solvent admixed with a composition selected from the group consisting of a first composition comprising a polymer containing halomethylated aromatic groups, and a charge transporting material selected from the group consisting of at least one charge transport monomer containing arylamine groups, at least one charge transport polymer containing arylamine units in the main polymer chain, and mixtures thereof, and a second composition comprising at least one monomer containing a halomethylated aromatic group, at least one charge transport monomer containing arylamine groups and a polymer binder, and a third composition comprising:

at least one monomer containing a halomethylated aromatic group, and at least one charge transport polymer with arylamine units in the main polymer chain, applying the coating solution on the substrate to form a coating, and drying the coating to forming an electrically conductive layer.

The substrate can have any suitable thickness. Typical substrates have a thickness is from about 50 micrometers to about 1,000 micrometers. A typical thickness for the conductive coating layer after drying is from 0.1 to about 5 micrometers. The conductive coatings may also be employed as layers in organic photoreceptors such as thick undercoat layers or overcoat layers. They can also be employed as coatings on scavengeless electroded donor rolls, semiconductive intermediate transfer belt ground planes, anti static films, and many other applications.

The following describes procedures for preparing chloromethylated polymers and aryl-amine containing polymers, the combination of which are electrically conductive.

For the "*Chloromethylation of Condensation Polymers Containing an Oxy*-1,4-*Phenylene Backbone,*" see W. H. Daly, S. Chotiwana, and R. Nielsen, *Polymer Preprints,* 1979, 20(1), 835 in which the chloromethylation of phenoxy resins, polyethersulfone and polyphenylene oxide with tin tetrachloride and 1-chloromethoxy-4-chlorobutane is reported. The chloromethylation of polyethersulfone and polyphenylene oxide can also be accomplished as described in V. Percec and B. Auman, *Makromol. Chem.,* 1984, 185, 2319.

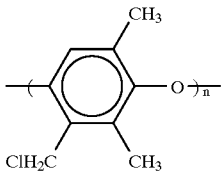

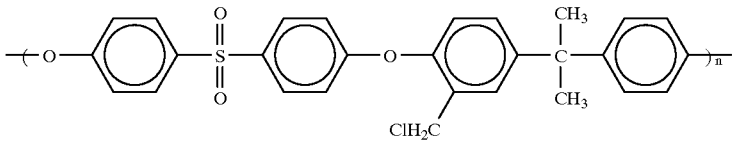

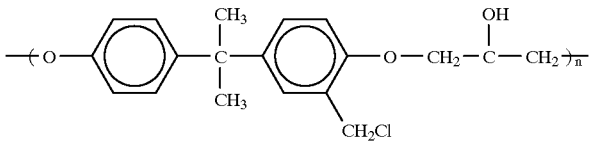

The chloromethylation of polystyrene is reviewed by M. E. Wright, E. G. Toplikar, and S. A. Svejda, *Macromolecules,* 1991, 24, 5879. The chloromethylation of high performance engineering polymers is described in U.S. Pat. No. 5,739, 254 and U.S. Pat. No. 5,753,783. Chloromethylated poly (arylene ether ketones) are available from Scientific Polymer Products with 2.0 ($SP^2$ 133-40-1) and 1.22 ($SP^2$ 133-90-2) chloromethyl groups per repeat unit.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

Examples I–XX below include descriptions of procedures for preparing chloromethylated polymers and aryl-amine containing polymers. The hydroxy- and chloro-terminated poly(arylene ether ketones) (PAE-HT and PAE-CT) and chloromethylated PAE (CM-PAE-HT and CM-PAE-CT) had the following structure.

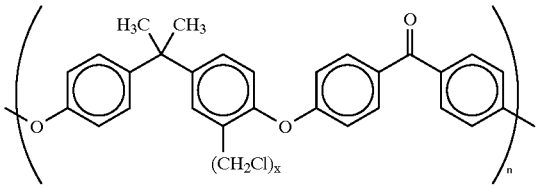

where
x=2, 1.44, 1.2, 1, 0.76, and 0.464

EXAMPLE I

Preparation of PAE-HT with a Number Average Molecular Weight of 2800

A polyarylene ether ketone of the formula:

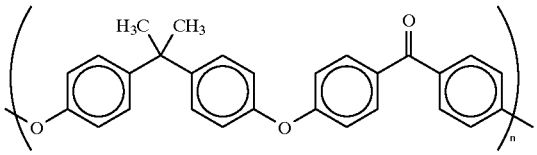

referred to as PAE-HT was prepared as follows. A 5-liter, 3-neck round-bottom flask equipped with a Dean-Stark (Barrett) trap, condenser, mechanical stirrer, argon inlet, and stopper was situated in a silicone oil bath. 4,4'-Dichlorobenzophenone (Aldrich 11,370-0, Aldrich Chemical Co., Milwaukee, Wis., 250 grams), bis-phenol A (Aldrich 23,965-8, 244.8 grams), potassium carbonate (327.8 grams), anhydrous NN-dimethylacetamide (1,500 milliliters), and toluene (275 milliliters) were added to the flask and heated to 175° C. (oil bath temperature) while the volatile toluene component was collected and removed. After heating 30 hours at 175° C. with continuous stirring, the reaction mixture was filtered to remove insoluble salts, and the resultant solution was added to methanol (5 gallons) to precipitate the polymer using a Waring blender. The polymer was isolated by filtration, and the wet filter cake was washed with water (3 gallons) and then with methanol (3 gallons). The yield was 360 grams of vacuum dried polymer. The molecular weight of the polymer as determined by gel permeation chromatography (gpc, using tetrahydrofuran as the elution solvent) was: $M_n$ 2,800, $M_{peak}$ 5,800, $M_w$ 6,500, $M_z$ 12,000 and $M_{z+1}$ 17,700. As a result of the stoichiometries used in the reaction, it is believed that this polymer had hydroxy end-groups derived from bis-phenol A. If the reaction is allowed to proceed for 35, 40, and 48 hours at 175° C., the respective Mn of the PAE-HT formed was 3,000, 3,300, and 4,000.

The Chloromethylation of PAE-HT

A polymer with the structure:

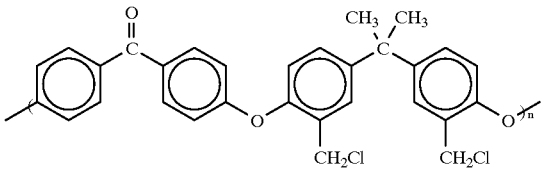

referred to as CM-PAE-HT was made as follows. A solution of chloromethyl methyl ether in methyl acetate was made by adding 282.68 grams (256 milliliters) of acetyl chloride to a mixture of dimethoxymethane (313.6 grams, 366.8 milliliters) and methanol (10 milliliters) in a 5-liter 3-neck round-bottom flask equipped with a mechanical stirrer, argon inlet, reflux condenser, and addition funnel. The solution was diluted with 1,066.8 milliliters of 1,1,2,2-tetrachloroethane and then tin tetrachloride (2.4 milliliters) was added via a gas-tight syringe, along with 1,1,2,2-tetrachloroethane (133.2 milliliters) using an addition funnel. The reaction solution was heated to 50° C. and a solution of PAE-HT (160.8 grams) in 1,1,2,2-tetrachloroethane (1,000 milliliters) was rapidly added. The reaction mixture was then heated to reflux with an oil bath set at 110° C. After four hours reflux with continuous stirring, heating was discontinued and the mixture was allowed to cool to 25° C. The reaction mixture was transferred in stages to a 2 liter round bottom flask and concentrated using a rotary evaporator with gentle heating up to 50° C. while reduced pressure maintained with a vacuum pump trapped with liquid nitrogen. The concentrate was added to methanol (6 gallons) to precipitate the polymer using a Waring blender. The polymer was isolated by filtration and vacuum dried to yield 200 grams of CM-PAE-HT with 1.5 chloromethyl groups per repeat unit as identified using $^1$H NMR spectrometry. When the reaction was carried out for 1, 2, 3, and 4 hours, the amount of chloromethyl groups per repeat unit was 0.76, 1.09, 1.29, and 1.50, respectively.

Solvent free polymer was obtained by reprecipitation of the polymer (75 grams) dissolved in methylene chloride (500 grams) into methanol (3 gallons) followed by filtration and vacuum drying to yield 70.5 grams.

When the reaction was carried out under similar conditions except that 80.4 grams of PAE-HT was used instead of 160.8 grams and the amounts of the other reagents were the same as indicated above, the polymer is formed with 1.31, 1.50, 1.75, and 2 chloromethyl groups per repeat unit in 1, 2, 3, and 4 hours, respectively, at 110° C. (oil bath temperature).

Preparation of CM-PAE-HT

The reaction above was repeated. A solution of chloromethyl methyl ether in methyl acetate was made by adding 282.68 grams (256 milliliters) of acetyl chloride to a mixture of dimethoxymethane (313.6 grams, 366.8 milliliters) and methanol (10 milliliters) in a 5 liter 3-neck round-bottom flask equipped with a mechanical stirrer, argon inlet, reflux condenser, and addition funnel. The solution was diluted with 1,066.8 milliliters of 1,1,2,2-tetrachloroethane and then tin tetrachloride (2.4 milliliters) was added via a gas-tight syringe along with 1,1,2,2-tetrachloroethane (133.2 milliliters) using an addition funnel. The reaction solution was heated to 50° C. Thereafter, a solution of PAE-HT (160.8 grams) prepared as described above in 1,000 milliliters of 1,1,2,2-tetrachloroethane was added rapidly. The reaction mixture was then heated to reflux with an oil bath set at 110° C. After four hours reflux with continuous stirring, heating was discontinued and the mixture was allowed to cool to 25° C. The reaction mixture was transferred in stages to a 2 liter round bottom flask and concentrated using a rotary evaporator with gentle heating up to 50° C. while reduced pressure was maintained with a vacuum pump trapped with liquid nitrogen. The concentrate was added to methanol (4 gallons) to precipitate the polymer using a Waring blender. The polymer was isolated by filtration and vacuum dried to yield 200 grams of CM-PAE-HT with 1.5 chloromethyl groups per repeat unit as identified using $^1$H NMR spectroscopy. When the same reaction was carried out for 1, 2, 3 and 4 hours, the amount of chloromethyl groups per repeat unit was 0.76, 1.09, 1.294, and 1.496, respectively.

Solvent free polymer was obtained by reprecipitation of the polymer (75 grams) in methylene chloride (500 grams) into methanol (300 grams) followed by filtration and vacuum drying to yield 70.5.

When the reaction was carried out under similar conditions except that 80.4 grams of PAE-HT was used instead of 160.8 grams and the amounts of the other reagents were the same as indicated above, the CM-PAE-HT is formed with 1.31, 1.50, 1.75, and 2 chloromethyl groups per repeat unit in 1, 2, 3, and 4 hours, respectively, at 110° C. (oil bath temperature).

When 241.2 grams of PAE-HT was used instead of 160.8 grams with the other reagents fixed, CM-PAE-HT was formed with 0.79, 0.90, 0.98, 1.06, 1.22, and 1.38 chloromethyl groups per repeat unit in 1, 2, 3, 4, 5 and 6 hours, respectively, at 110° C. (oil bath temperature).

When 321.6 grams of PAE-HT was used instead of 160.8 grams with the other reagents fixed, CM-PAE-HT was formed with 0.53, 0.59, 0.64, 0.67, 0.77, 0.86, 0.90, and 0.97 chloromethyl groups per repeat unit in 1, 2, 3, 4, 5, 6, 7, and 8 hours, respectively, at 110° C. (oil bath temperature).

EXAMPLE II

Preparation of Hydroxy-Terminated Poly(Arylene Ether Ketone) with Mn 3,340

A polyarylene ether material of the formula:

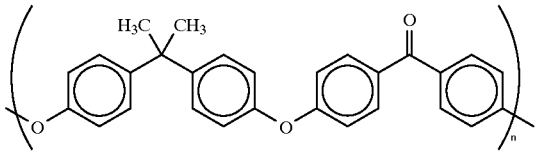

referred to as PAE-HT was prepared as follows. A 5 liter, 3-neck round-bottom flask equipped with a Dean-Stark (Barrett) trap, condenser, mechanical stirrer, argon inlet, and stopper was situated in a silicone oil bath. 4,4'-Dichlorobenzophenone (Aldrich 11,370-0, Aldrich Chemical Co., Milwaukee, Wis., 400 grams), bis-phenol A (Aldrich 13,302-7, 391.68 grams), potassium carbonate (Aldrich 20,961-9, 524.48 grams), anhydrous N,N-dimethylacetamide (Aldrich-Sigma, 27,055-5, 2400 milliliters), and toluene (440 milliliters, 383.2 grams) were added to the flask and heated to 175° C. while the volatile toluene component was collected and removed. After 36 hours of heating at 175° C. with continuous stirring, the reaction mixture was filtered to remove insoluble salts, and the resultant solution was added to methanol (5 gallons) to precipitate the polymer using a Waring blender. The polymer was isolated by filtration, and the wet filter cake was washed with water (5 gallons) and then with methanol (5 gallons). The yield was 886.6 grams of vacuum dried PAE-HT. The molecular weight of the polymer was $M_n$ 3,340, $M_w$ 8,200, $M_{peak}$ 7,300, $M_z$ 15,140, $M_{z+1}$ 22,040, and the polydispersity was 2.45, as determined by gel permeation chromatography (tetrahydrofuran was the elution solvent). The glass transition temperature of the polymer was 125° C., as determined using differential scanning calorimetry at a heating rate of 20° C. per minute. Solution cast films from methylene chloride were clear, tough, and flexible. As a result of the stoichiometries used in the reaction, it is believed that this polymer had hydroxyl end-groups derived from bis-phenol A.

Preparation of CM-PAE-HT with 1.5 Chloromethyl Groups per Repeat Unit

A polyarylene ether material of the formula:

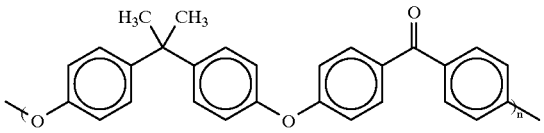

was prepared as described above. A solution of chloromethyl methyl ether in methyl acetate was made by adding 282.68 grams (256 mL) of acetyl chloride (Aldrich 11,418-9) to a mixture of dimethoxymethane (Aldrich D13,465-1, 313.6 grams, 366.8 milliliters) and methanol (10 milliliters) in a 5-liter, 3-neck round-bottom flask equipped with a mechanical stirrer, argon inlet, reflux condenser, and addition funnel. The solution was diluted with 1066.8 milliliters of 1,1,2,2-tetrachloroethane (Aldrich 18,543-4) and then tin tetrachloride (Aldrich 20,893-0, 2.4 milliliters, added via syringe) was added in 133.2 mL of 1,1,2,2-tetrachloroethane. The reaction mixture was heated to 50° C. and a solution of PAE-HT (80.4 grams) in 1000 mL of 1,1,2,2-tetrachlorethane was rapidly added. The reaction mixture was heated to reflux with an oil bath set at 110° C. After four hours reflux with continuous stirring, heating was discontinued and the mixture was allowed to cool to 25° C. The reaction mixture was transferred to a rotary evaporator with gentle heating up to 50° C. When most of the volatiles had been removed, the reaction mixture was added to methanol (50 milliliters of solution were added to each 0.75 liter of methanol) to precipitate the polymer using a Waring blender. The precipitated polymer was collected by filtration, washed with methanol, and air-dried to yield 85 grams of off-white powder. The polymer had 2.0 chloromethyl groups per repeat unit with the formula

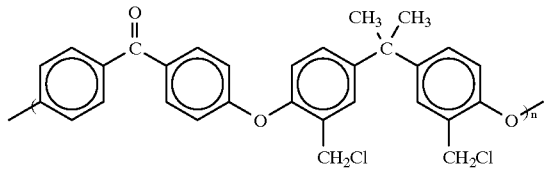

as analyzed using $^1H$ NMR spectrometry in $CDCl_3$. The amount of chloromethyl groups per repeat unit is obtained by dividing the integral for the cluster of peaks around 4.62 ppm ($CH_2Cl$) by 2 which in turn is divided by the integral of the peak at 1.73 ppm (isopropylidene methyl protons) divided by 6.

If 160.8 grams of PAE-HT is used instead of 80.4 grams under the same reaction conditions, CM-PAE-HT with 1.5 chloromethyl groups is obtained with the following structure:

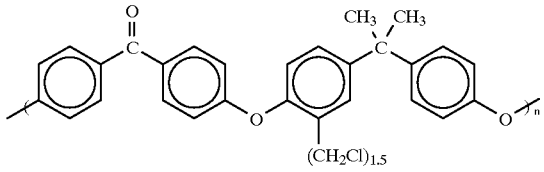

EXAMPLE III

Preparation of PAE-CT with Mn 4,240 and Mn 7,220

A polyarylene ether material of the formula:

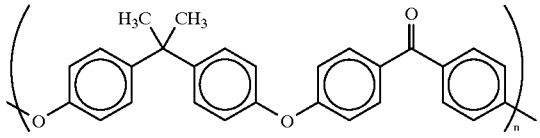

(referred to as PAE-CT) was prepared as follows. A 5-liter, 3-neck round-bottom flask equipped with a Dean-Stark (Barrett) trap, condenser, mechanical stirrer, argon inlet, and stopper was situated in a silicone oil bath. 4,4'-Dichlorobenzophenone (Aldrich 11,370-0, Aldrich Chemical Co., Milwaukee, Wis., 430.88 grams), bis-phenol A (Aldrich 13,302-7, 363.6 grams), potassium carbonate (Aldrich 20,961-9, 524.48 grams), anhydrous N,N-dimethylacetamide (Aldrich-Sigma 27,055-5, 2,400 milliliters), and toluene (440 milliliters, 383.2 grams) were added to the flask and heated to 175° C. while the volatile toluene component was collected and removed. After 24 hours of heating at 175° C. with continuous stirring, the reaction mixture was filtered to remove insoluble salts, and the resultant solution was added to methanol (5 gallons) to precipitate the polymer using a Waring blender. The polymer was isolated by filtration, and the wet filter cake was washed with water (5 gallons) and then with methanol (3 gallons). The yield was 708.8 grams of vacuum dried CM-PAE-CT. The molecular weight of the polymer was determined by gel permeation chromatography (gpc elution solvent was tetrahydrofuran) with the following results: $M_n$ 4,240, $M_{peak}$ 9,200, $M_w$ 10,240, $M_z$ 18,200, and $M_{z+1}$ 25,900. The glass transition temperature of the polymer was 135° C. as determined using differential scanning calorimetry at a heating rate of 20° C. per minute. As a result of the stoichiometries used in the reaction, it is believed that this polymer had end-groups derived from dichlorobenzophenone. When the reaction was allowed to continue for 48 hours, the molecular weight of the chloro-ended PAE was Mn 7,220 and Mw 21,430.

A solution of chloromethyl methyl ether in methyl acetate was made by adding acetyl chloride (Aldrich 11,418-9, 184 g) to a mixture of dimethoxymethane (Aldrich D13,465-1, 193 grams, 225 milliliters) and methanol (6.25 milliliters) in a 5-liter, 3-neck round-bottom flask equipped with a mechanical stirrer, argon inlet, reflux condenser, and addition funnel. The solution was diluted with 500 milliliters of 1,1,2,2-tetrachloroethane (Aldrich 18,543-4) and then tin tetrachloride (Aldrich 20,893-0, 4.0 milliliters, added via syringe). The reaction mixture was heated to 50° C. and a solution of PAE-CT (75 grams) in 625 mL of 1,1,2,2-tetrachlorethane was rapidly added. The reaction mixture was heated to reflux with an oil bath set at 110° C. After four hours reflux with continuous stirring, heating was discontinued and the mixture was allowed to cool to 25° C. The reaction mixture was transferred to a rotary evaporator with gentle heating up to 50° C. When most of the volatiles had been removed, the reaction mixture was added to methanol (50 milliliters of solution were added to each 0.75 liter of methanol) to precipitate the polymer using a Waring blender. The precipitated polymer was collected by filtration, washed with methanol, and air-dried to yield 75 grams of off-white powder. The polymer had 0.956 chloromethyl groups per repeat unit with the formula

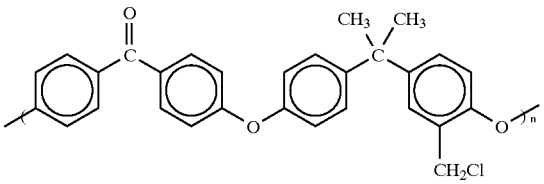

as analyzed using $^1H$ NMR spectrometry in $CDCl_3$. The amount of chloromethyl groups per repeat unit is obtained by dividing the integral for the cluster of peaks around 4.62 ppm ($CH_2Cl$) by 2 which in turn is divided by the integral of the peak at 1.73 ppm (isopropylidene methyl protons) divided by 6.

Preparation of CM-PAE-CT with 1.53 Chloromethyl Groups per Repeat Unit

A polyarylene ether material of the formula:

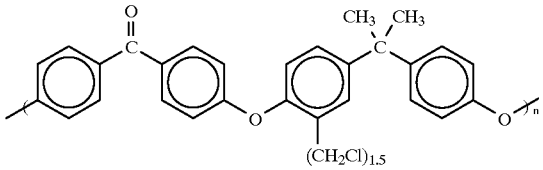

was prepared as follows. A solution of chloromethyl ether in methyl acetate was made by adding 282.68 grams (256 mL) of acetyl chloride (Aldrich 11,418-9) to a mixture of dimethoxymethane (Aldrich D13,465-1, 313.6 milliliters, 356.8 mL) and methanol (10 milliliters) in a 5-liter, 3-neck round-bottom flask equipped with a mechanical stirrer, argon inlet, reflux condenser, and addition funnel. The solution was diluted with 1066.8 milliliters of 1,1,2,2-tetrachloroethane and then tin tetrachloride (2.4 milliliters) was added via syringe in 1,1,2,2-tetrachloroethane (133.2 mL). The solution was heated to 50° C. Thereafter, a solution of PAE-CT (160.8 grams) in 1000 milliliters of 1,1,2,2-tetrachloroethane was added rapidly. The reaction mixture was heated to reflux using a silicone oil bath set at 110° C. After 5 hours at reflux with continuous stirring, heating was discontinued and the mixture was allowed to cool to 25° C. The reaction mixture was added to methanol (5 gallons, such that, 25 milliliter solution was added to each 0.75 liter of methanol) to precipitate the polymer using a Waring blender. The precipitated polymer was collected by filtration, washed with methanol, and air-dried to yield 160 grams of off-white powder. The polymer had about 1.53 $CH_2Cl$ groups per polymer repeat unit. The amount of chloromethylation with reaction time was monitored by $^1H$ NMR spectrometry with the following results: 2 hours, 0.83 $CH_2Cl$/repeat unit; 4 hours, 1.31 $CH_2Cl$/repeat unit; and 5 hours, 1.53 $CH_2Cl$/repeat unit. The molecular weight of the product was $M_n$ 5,580, $M_w$ 17,200, $M_{peak}$ 15,200, and $M_z$ 36,800.

EXAMPLE IV

The Reaction of 4,4'-Difluorobenzophenone with Bisphenol A to Prepare PAE-HT with Mn 5,200

A polymer of the following structure:

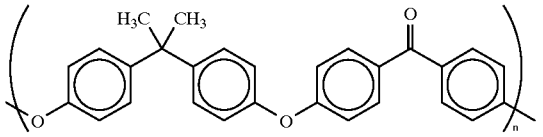

referred to as poly(4-FPK-BPA) was made. A 1-liter, 3-neck round-bottom flask equipped with a Dean-Stark (Barrett) trap, condenser, mechanical stirrer, argon inlet, and stopper was situated in a silicone oil bath. 4,4'-Difluorobenzophenone (Aldrich Chemical Co., Milwaukee, Wis., 16.59 grams, 0.0.0705 mol), bisphenol A (Aldrich 14.18 grams, 0.065 mol), potassium carbonate (21.6 grams), anhydrous N,N-dimethylacetamide (100 milliliters), and toluene (30 milliliters) were added to the flask and heated to 175° C. (oil bath temperature) while the volatile toluene component was collected and removed. After 4 hours of heating at 175° C. with continuous stirring, the reaction mixture was allowed to cool to 25° C. The solidified mass was treated with acetic acid (vinegar) and extracted with methylene chloride, filtered, and added to methanol to precipitate a polymer using a Waring blender. The polymer was collected by filtration, washed with water, and then was washed with methanol. The yield of vacuum dried product, poly(4-FPK-BPA), was 12.22 grams. The polymer (26952-48) was analyzed by gel permeation chromatography (gpc elution solvent was tetrahydrofuran) with the following results: $M_n$ 5,158, $M_{peak}$ 15,080, $M_w$ 17,260, and $M_{z+1}$ 39,290. For a lower molecular weight, repeat the reaction with a 15 mol % offset in stoichiometry.

Preparation of Hydroxy-Terminated Poly(Arylene Ether Ketone) with Mn 5,400

PAE-HT of the formula:

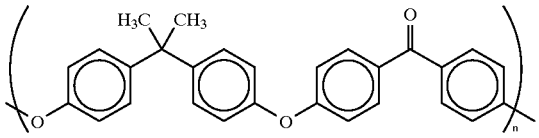

was prepared as follows. A 1-liter, 3-neck round-bottom flask equipped with a Dean-Stark (Barrett) trap, condenser, mechanical stirrer, argon inlet, and stopper was situated in a silicone oil bath. 4,4'-Dichlorobenzophenone (Aldrich 11,370-0, Milwaukee, Wis., 50 grams), bisphenol A (Aldrich 23,965-8, 48.96 grams), potassium carbonate (65.56 grams), anhydrous N,N-dimethylacetamide (300 milliliters), and toluene (55 milliliters) were added to the flask and heated to 175° C. (oil bath temperature) while the volatile toluene component was collected and removed. After 24 hours of heating at 175° C. with continuous stirring, an aliquot of the reaction product that had been precipitated into methanol was analyzed by gel permeation chromatography (gpc, elution solvent was tetrahydrofuran) with the following results: $M_n$ 4,460, $M_{peak}$ 7,580, $M_w$ 7,930, $M_z$ 12,330, and $M_{z+1}$ 16,980. After 48 hours at 175° C. with continuous stirring, the reaction mixture was filtered to remove potassium carbonate and precipitated into methanol (2 gallons). The PAE-HT product was isolated by filtration and air-dried. GPC analysis was as follows: $M_n$ 5,350, $M_{peak}$ 16,130, $M_w$ 15,600, $M_w$ 15,600, $M_z$ 29,200 and $M_{z+1}$ 42,700. The glass transition temperature was 135° C. as determined using differential scanning calorimetry at a heating rate of 20° C. per minute. As a result of the stoichiometries used in the reaction, it is believed that this polymer has hydroxyl end-groups derived from bis-phenol A.

EXAMPLE V

Preparation of Hydroxy-Terminated Poly(Arylene Ether Ketone) with Mn 30,000

A polyarylene ether ketone of the formula:

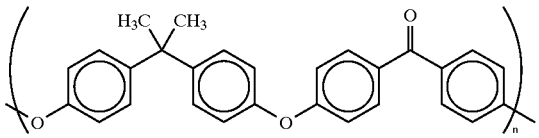

wherein n is about 123 (hereinafter referred to as poly(4-FPK-BPA)) was prepared as follows. A 1 liter, 3-neck round-bottom flask equipped with a Dean-Stark (Barrett) trap, condenser, mechanical stirrer, argon inlet, and stopper was situated in a silicone oil bath. 4,4'-Difluorobenzophenone (Aldrich 11,549-5, Aldrich Chemical Co., Milwaukee, Wis., 21.82 grams), bis-phenol A (Aldrich 23,965-8, 22.64 grams), potassium carbonate (40.0 grams), anhydrous N,N-dimethylacetamide (300 milliliters), and toluene (52 milliliters) were added to the flask and heated to 175° C. (oil bath temperature) while the volatile toluene component was collected and removed. After 5 hours of heating at 175° C. with continuous stirring, phenol (5 grams) was added and heating at 170° C. with stirring was continued for 30 minutes more. After cooling to 25° C., the reaction mixture was stirred with 500 grams of methylene chloride and filtered to remove potassium carbonate. The filtrate was added to methanol (3 gallons). The precipitate was collected by filtration, washed with 2.5 gallons of water, and then with 1 gallon of methanol. The polymer (poly(4-FPK-BPA)) was isolated in 90% yield after filtration and drying in vacuo. GPC analysis was as follows: $M_n$ 30,000, $M_w$ 75,000. The glass transition temperature of the polymer was about 140° C. as determined using differential scanning calorimetry at a heating rate of 20° C. per minute. As a result of the stoichiometries used in the reaction, it is believed that this polymer had end groups derived from oxy-phenyl groups. The polymer dissolved in methylene chloride at 10% solids was added to methanol (1 gallon) using a Waring blender to reprecipitate the polymer. The polymer was isolated by filtration and vacuum dried. This material was used as the transport layer in photoreceptors.

A solution of chloromethyl methyl ether in methyl acetate was made by adding acetyl chloride (Aldrich 11,418-9, 140.1 g, 128 mL) to a mixture of dimethoxymethane (Aldrich D13,465-1, 157.6 grams) and methanol (5 milliliters) in a 5-liter, 3-neck round-bottom flask equipped with a mechanical stirrer, argon inlet, reflux condenser, and addition funnel. The solution was diluted with 500 milliliters of 1,1,2,2-tetrachloroethane (Aldrich 18,543-4), and then tin tetrachloride (Aldrich 20,893-0, 0.6 milliliters) was added via syringe. The reaction mixture was heated to 50° C. and a solution of PAE-CT (40 grams) in 500 mL of 1,1,2,2-tetrachlorethane was rapidly added. The reaction mixture was heated to reflux with an oil bath set at 110° C. After two hours reflux with continuous stirring, heating was discontinued and the mixture was allowed to cool to 25° C. The reaction mixture was transferred to a rotary evaporator with gentle heating up to 50° C. When most of the volatiles had been removed, the reaction mixture was added to methanol (50 milliliters of solution were added to each 0.75 liter of methanol) to precipitate the polymer using a Waring blender. The precipitated polymer was collected by filtration, washed with methanol, and air-dried to yield 45.7 grams of off-white powder. The polymer had 1.44 chloromethyl groups per repeat unit with the formula:

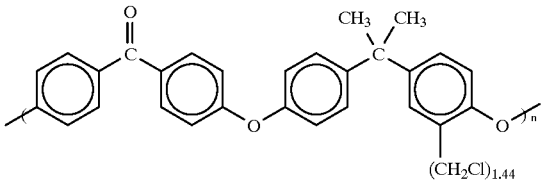

as analyzed using $^1H$ NMR spectrometry in $CDCl_3$. The amount of chloromethyl groups per repeat unit is obtained by dividing the integral for the cluster of peaks around 4.62 ppm ($CH_2Cl$) by 2 which in turn is divided by the integral of the peak at 1.73 ppm (isopropylidene methyl protons) divided by 6.

EXAMPLE VI

The Reaction of 4,4'-Dichlorobenzophenone and Bis-(4-Hydroxyphenyl)methane

A polymer of the formula:

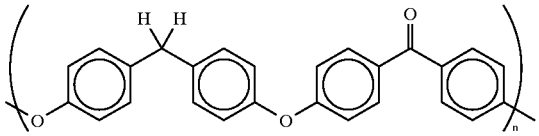

referred to as poly(CPK-BPM) was made as follows. A 500-mL, 3-neck round-bottom flask equipped with a Dean-Stark (Barrett) trap, condenser, mechanical stirrer, argon inlet, and stopper was situated in a silicone oil bath. 4,4'-Dichlorobenzophenone (Aldrich 11,370-0, Aldrich Chemical Co., Milwaukee, Wis., 16.32 grams, 0.065 mol), bis(4-hydroxyphenyl)methane (Aldrich, 14.02 grams, 0.07 mol), potassium carbonate (21.41 grams), anhydrous N,N-dimethylacetamide (100 milliliters), and toluene (100 milliliters) were added to the flask and heated to 175° C. (oil bath temperature) while the volatile toluene component was collected and removed. After 48 hours of heating at 175° C. with continuous stirring, the reaction mixture was filtered, and added to methanol to precipitate a polymer using a Waring blender. The polymer was collected by filtration, washed with water, and then was washed with methanol. The yield of vacuum dried product, poly(4-CPK-BPM), was 24 grams. The polymer dissolved on heating in N-methylpyrrolidinone, N,N-dimethylacetamide, and 1,1,2,2-tetrachloroethane.

The Chloromethylation of Poly(4-CPK-BPM)

The polymer poly(4-CPK-BPM) of the structure:

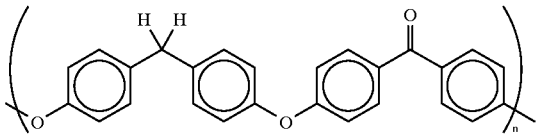

was chloromethylated as follows. A solution of chloromethyl methyl ether (6 mmol/mL) in methyl acetate was prepared by adding acetyl chloride (35.3 grams) to a mixture of dimethoxymethane (45 mL) and methanol (1.25 mL). The abbreviation mmol represents milli moles. The solution was diluted with 150 mL of 1,1,2,2-tetrachloroethane and then tin tetrachloride (0.3 mL) was added. After taking the mixture to reflux using an oil bath set at 110° C., a solution of poly(4-CPK-BPM) (10 grams, 26951-70) in 125 mL of 1,1,2,2-tetrachloroethane was added. Reflux was maintained for 2 hours and then 5 mL of methanol were added to quench the reaction. The reaction solution was added to 1 gallon of methanol using a Waring blender to precipitate the product, chloromethylated poly(4-CPK-BPM), which was collected by filtration and vacuum dried. The yield was 9.46 grams of poly(4-CPK-BPM) with 2 chloromethyl groups per polymer repeat unit. The polymer product had the structure:

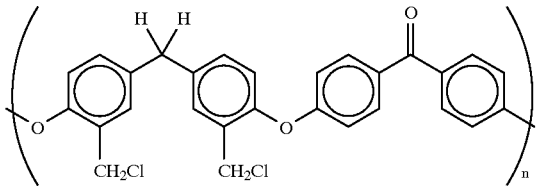

EXAMPLE VII

Reaction of 4,4'-Dichlorobenzophenone and Hexafluorobisphenol A

A polymer of the formula:

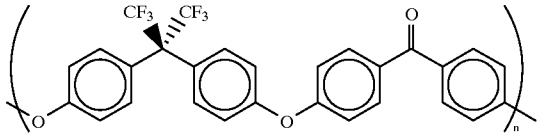

referred to as Poly(4-CPK-HFBPA) was made as follows. A 500-mL, 3-neck round-bottom flask equipped with a Dean-Stark (Barrett) trap, condenser, mechanical stirrer, argon inlet, and stopper was situated in a silicone oil bath. 4,4'-Dichlorobenzophenone (Aldrich 11,370-0, Aldrich Chemical Co., Milwaukee, Wis., 16.32 grams, 0.065 mol), hexafluorobisphenol A (Aldrich, 23.52 grams, 0.07 mol), potassium carbonate (21.41 grams), anhydrous N,N-dimethylacetamide (100 milliliters), and toluene (100 milliliters) were added to the flask and heated to 175° C. (oil bath temperature) while the volatile toluene component was collected and removed. After 48 hours of heating at 175° C. with continuous stirring, the reaction mixture was filtered, and added to methanol to precipitate a polymer which was collected by filtration, washed with water, and then was washed with methanol. The yield of vacuum dried product, poly(4-CPK-HFBPA), was 20 grams. The polymer (26952-2) was analyzed by gel permeation chromatography (gpc elution solvent was tetrahydrofuran) with the following results: $M_n$ 1,980, $M_{peak}$ 2,280, $M_w$ 3,590, and $M_{z+1}$ 8,920.

A solution of chloromethyl methyl ether (6 mmol/mL) in methyl acetate was prepared by adding acetyl chloride (7.06 grams) to a mixture of dimethoxymethane (7.84 mL) and methanol (0. 25 mL). The solution was diluted with 30 mL of 1,1,2,2 -tetrachloroethane and then tin tetrachloride (0.06 mL) was added. After taking the mixture to reflux using an oil bath set at 110° C., a solution of poly(4-CPK-BPM) (2 grams) in 25 mL of 1,1,2,2-tetrachloroethane was added. Reflux was maintained for 24 hours and then 5 mL of methanol were added to quench the reaction. The reaction solution was added to 1 liter of methanol using a Waring blender to precipitate the chloromethylated product which was collected by filtration and vacuum dried. The yield was 2 grams of product with 0.1 chloromethyl groups per polymer repeat unit.

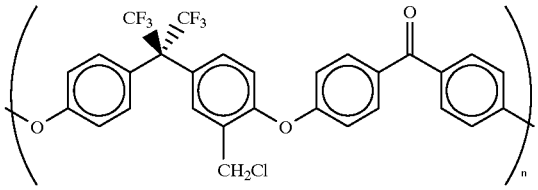

EXAMPLE VIII

The Reaction of 4,4'-Difluorobenzophenone and 9, 9'-Bis(4-Hydroxyphenyl)fluorenone (Fluorenone Bisphenol)

A high molecular weight polymer of the formula:

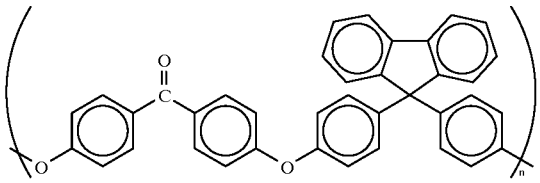

referred to as poly(4-FPK-FBP) was prepared as follows. A 1-liter, 3-neck round-bottom flask equipped with a Dean-Stark (Barrett) trap, condenser, mechanical stirrer, argon inlet, and stopper was situated in a silicone oil bath. 4,4'-Difluorobenzophenone (Aldrich Chemical Co., Milwaukee, Wis., 43.47 grams, 0.1992 mol), 9,9'-bis(4-hydroxyphenyl) fluorenone (Ken Seika, Rumson, N.J., 75.06 grams, 0.2145 mol), potassium carbonate (65.56 grams), anhydrous NN-dimethylacetamide (300 milliliters), and toluene (52 milliliters) were added to the flask and heated to 175° C. (oil bath temperature) while the volatile toluene component was collected and removed. After 5 hours of heating at 175° C. with continuous stirring, the reaction mixture was allowed to cool to 25° C. The solidified mass was treated with acetic acid (vinegar) and extracted with methylene chloride, filtered, and added to methanol to precipitate a polymer which was collected by filtration, washed with water, and then was washed with methanol. The yield of vacuum dried product, poly(4-FPK-FBP), was 71.7 grams. The polymer (26952-27) was analyzed by gel permeation chromatography (gpc elution solvent was tetrahydrofuran) with the following results: $M_n$ 59,100, $M_{peak}$ 144,000, $M_w$ 136,100, $M_z$ 211,400, and $M_{z+1}$ 286,100.

EXAMPLE IX

The Reaction of 4,4'-Dichlorobenzophenone and 9, 9'-Bis(4-Hydroxyphenyl)fluorenone (Fluorenone Bisphenol)

A low molecular weight polymer of the structure:

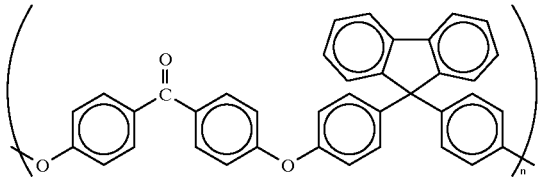

referred to as poly (4-CPK-FBP) was made as follows. A 1-liter, 3-neck round-bottom flask equipped with a Dean-Stark (Barrett) trap, condenser, mechanical stirrer, argon inlet, and stopper was situated in a silicone oil bath. 4,4'-Dichlorobenzophenone (Aldrich Chemical Co., Milwaukee, Wis., 50.02 grams, 0.1992 mol), 9,9'-bis(4-hydroxyphenyl) fluorenone (Ken Seika, Rumson, N.J., 75.04 grams, 0.2145 mol), potassium carbonate (65.56 grams), anhydrous N,N-dimethylacetamide (300 milliliters), and toluene (52 milliliters) were added to the flask and heated to 175° C. (oil bath temperature) while the volatile toluene component was collected and removed. After 24 hours of heating at 175° C. with continuous stirring, the reaction mixture was allowed to cool to 25° C. The reaction mixture was filtered, and added to methanol to precipitate a polymer which was collected by filtration, washed with water, and then was washed with methanol. The yield of vacuum dried product, poly(4-CPK-FBP), was 60 grams. The polymer had the molecular weight Mn 3,110 and Mw 4,180.

The Chloromethylation of Poly(4-CPK-FBP)

A chloromethylated polymer of the following structure:

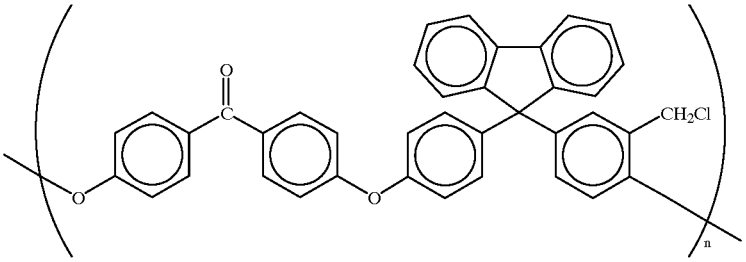

was made as follows. A solution of chloromethyl methyl ether (6 mmol/mL) in methyl acetate was prepared by adding acetyl chloride (38.8 grams) to a mixture of dimethoxymethane (45 mL) and methanol (1.25 mL). The solution was diluted with 100 mL of 1,1,2,2-tetrachloroethane and then tin tetrachloride (0.5 mL) was added in 50 mL of 1,1,2,2-tetrachloroethane. After heating the mixture using an oil bath set at 100° C., a solution of poly(4-CPK-FBP) (10 grams) in 125 mL of 1,1,2,2-tetrachloroethane was added. The reaction temperature was maintained at 100° C. for 1 hours and then 5 mL of methanol were added to quench the reaction. The reaction solution was added to 1 gallon of methanol using a Waring blender to precipitate the product, chloromethylated poly(4-CPK-FBP), which was collected by filtration and vacuum dried. The yield was 9.5 grams of poly(4-CPK-FBP) with 1.56 chloromethyl groups per polymer repeat unit. If the reaction is carried out at 110° C. (oil bath set temperature), the polymer gelled within 80 minutes.

EXAMPLE X

Preparation of PAE with Acetoxy Groups

A chloromethylated polyarylene ether ketone having 1.5 chloromethyl groups per repeat unit was prepared. A solution containing 10 grams of the chloromethylated polymer (CM-PAE-HT) in 71 milliliters of N,N-dimethyl acetamide was magnetically stirred with 5.71 grams of sodium acetate (obtained from Aldrich Chemical Co., Milwaukee, Wis.). The reaction was allowed to proceed for one week. The reaction mixture was then centrifuged and the supernate was added to methanol (0.5 gallon) to precipitate the polymer using a Waring blender. The polymer was then filtered, washed with water (2 liters), and subsequently washed with methanol (0.5 gallon). Approximately half of the chlorine atoms on the chloromethyl groups were replaced with acetoxy groups, and the polymer was of the formula:

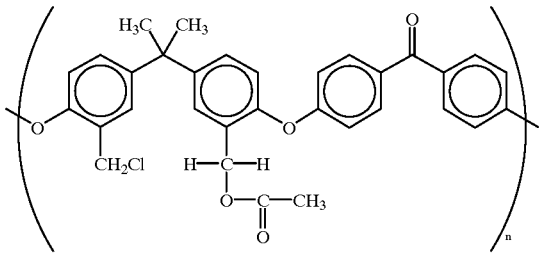

EXAMPLE XI

Preparation of A Chloromethylated, Fluorinated Poly(Arylene Ether)

A polyarylene ether ketone of the formula:

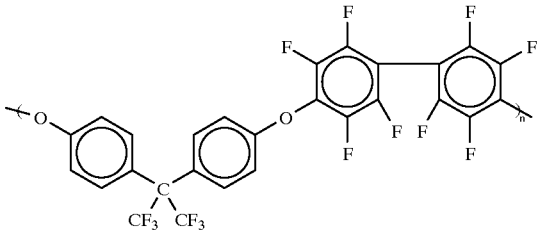

wherein n is about 120 (hereinafter referred to as poly(4-DFBP-HFBPA)) was prepared as follows. A 500-milliliter, 3-neck round-bottom flask equipped with a Dean-Stark (Barrett) trap, condenser, mechanical stirrer, argon inlet, and stopper was situated in a silicone oil bath. Decafluorobiphenyl (Aldrich D22-7, Aldrich Chemical Co., Milwaukee, Wis., 5 grams), 4,4'-(hexafluoroisopropylidene)diphenol (Aldrich 25,759-1, 5.08 grams), potassium carbonate (12.3 grams), toluene (10 milliliters) and anhydrous N,N-dimethylacetamide (75 milliliters) were added to the flask and heated at 135° C. (oil bath temperature) for 30 minutes with continuous stirring. The reaction mixture was allowed to cool to 25° C. The reaction mixture was stirred with 250 grams of tetrahydrofuran, filtered to remove potassium carbonate, concentrated using a rotary evaporator, and then precipitated into methanol (1 gallon). The precipitate was collected by filtration, washed with 2.5 gallons of water, and then with 1 gallon of methanol. The polymer (poly(4-FPK-HFBPA) was isolated in 90% yield after filtration and drying in vacuo. As a result of the stoichiometries used in the reaction, it is believed that this polymer had end groups derived from HFBPA groups. The polymer dissolved in tetrahydrofuran at 10% solids was added to methanol (1 gallon) using a Waring blender to reprecipitate the polymer. The polymer was isolated by filtration and vacuum dried.

Chloromethylation of the above polymer was accomplished to produce a polymer with the structure with 0.1 chloromethyl groups per repeat unit by the following procedure:

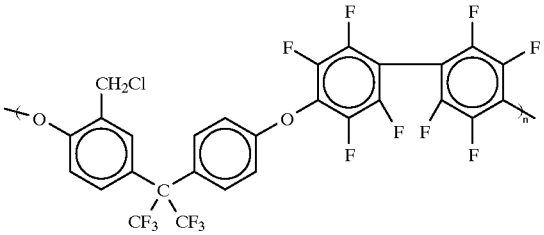

A solution of chloromethyl methyl ether (6 mmol/mL) in methyl acetate was prepared by adding acetyl chloride (7.06 grams) to a mixture of dimethoxymethane (7.84 mL) and methanol (0. 25 mL). The solution was diluted with 30 mL of 1,1,2,2-tetrachloroethane and then tin tetrachloride (0.06 mL) was added. After taking the mixture to reflux using an oil bath set at 110° C., a solution of poly(4-CPK-BPM) (2 grams) in 25 mL of 1,1,2,2-tetrachloroethane was added. Reflux was maintained for 24 hours and then 5 mL of methanol were added to quench the reaction. The reaction solution was added to 1 liter of methanol using a Waring blender to precipitate the chloromethylated product which was collected by filtration and vacuum dried. The yield was 2 grams of product with 0.1 chloromethyl groups per polymer repeat unit.

EXAMPLE XII

Chloromethylation of Makrolon Polycarbonate

A chloromethylated Makrolon polycarbonate of the formula:

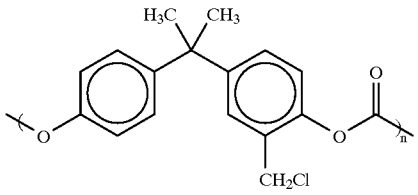

was prepared as follows. A solution of chloromethyl methyl ether in methyl acetate was made by adding 70 milliliters of acetyl chloride (73.9 grams, Aldrich 11,418-9) to a mixture of dimethoxymethane (Aldrich D13,465-1, 90 milliliters) and methanol (2.5 milliliters) in a 5-liter, 3-neck round-bottom flask equipped with a mechanical stirrer, argon inlet, reflux condenser, and addition funnel. The solution was diluted with 200 milliliters of 1,1,2,2-tetrachloroethane (Aldrich 18,543-4) and then tin tetrachloride (Aldrich 20,893-0, 0.8 milliliters, added via syringe) was added in 100 mL of 1,1,2,2-tetrachloroethane. The reaction mixture was heated to 50° C. and a solution of Makrolon polycarbonate (20 grams) in 250 mL of 1,1,2,2-tetrachlorethane was rapidly added. The reaction mixture was heated to reflux with an oil bath set at 110° C. After 24 hours reflux with continuous stirring, heating was discontinued and the mixture was allowed to cool to 25° C. The reaction mixture was transferred to a rotary evaporator with gentle heating up to 50° C. When most of the volatiles had been removed, the reaction mixture was added to methanol (50 milliliters of solution were added to each 0.75 liter of methanol) to precipitate the polymer using a Waring blender. The precipitated polymer was collected by filtration, washed with methanol, and air-dried to yield 85 grams of off-white powder. The polymer had 0.4 chloromethyl groups per repeat unit as analyzed using $^1H$ NMR spectrometry in $CDCl_3$. The amount of chloromethyl groups per repeat unit is obtained by dividing the integral for the cluster of peaks around 4.62 ppm ($CH_2Cl$) by 2 which in turn is divided by the integral of the peak at 1.73 ppm (isopropylidene methyl protons) divided by 6. The yield of chloromethylated polymer was 21.7 grams.

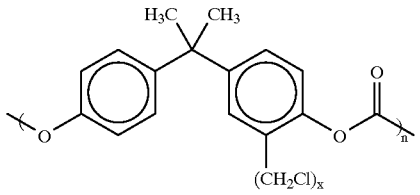

Similarly, chloromethylated polycarbonates were made where x=0.071 (after 3 hours of reflux under the same reaction conditions) and 0.14 (after 8 hours of reflux under the same reaction conditions).

EXAMPLE XIII

Chloromethylated Polystyrenes

A chloromethylated polystyrene with the structure:

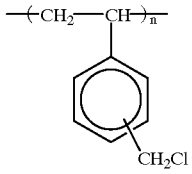

was purchased from either Aldrich or Scientific Polymer Products (Cat. Number 311) and had a molecular weight of 50,000. The polymer consisted of a 60:40 mixture of meta and para isomers.

A 19-mol. % chloromethylated polystyrene was also made as follows. To a 3-liter, 3-neck round-bottom flask equipped with a condenser, argon inlet, and stopper and situated in an oil bath was added the following: styrene (43.7 grams), chloromethylated styrene (15.1 g), toluene (450 mL) and azobisisobutyronitile (2.5 g). The reaction mixture was stirred under argon for 30 minutes and was then heated to 100° C. for 20 hours. The reaction mixture was taken to dryness using a rotary evaporator. The residue (36.1 grams) in methylene chloride was added to methanol to reprecipitate the polymer product with the structure:

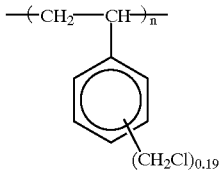

EXAMPLE XIV

The chloromethylated polymers prepared above in Examples I through VII and IX through XIII (2.00 grams) were each roll milled with methylene chloride (22.44 grams) and N,N'-diphenyl-N,N'-bis(3"-methylphenyl)-(1,1'-biphenyl)-4,4'-diamine (charge transport material, prepared as disclosed in U.S. Pat. No. 4,265,990, the entire disclosure thereof being incorporated herein by reference) (2.00 grams). The resulting solutions were coated onto Mystar (conductive carbon coated polyimide; this substrate being hereinafter referred to as substrate 1) or a 3 mil thick polyethylene terephthalate substrate having a vacuum deposited titanium coating about 200 Angstroms thick, a 3-aminopropyltriethoxysilane charge blocking layer 300 Angstroms thick, and a 49 micron thick polyester adhesive layer (49,000, obtained from E.I. du Pont de Nemours & Co., Wilmington, Del.), as an interfacial layer (IFL) about 400 Angstroms thick. This substrate is hereinafter referred to as substrate 2. The solutions were applied using an 8 mil gap Bird applicator to form a coating which was heated from 40 to 100° C. over 30 minutes to dry the layer. The charge transport layer thus applied to the imaging member each had a dry coating thickness of about 25 microns. The devices were tested for their chargeability in a scanner as follows: each device was mounted on a cylindrical aluminum drum substrate which was rotated on a shaft of a scanner. Each device was charged by a corotron mounted along the periphery of the drum. The surface potential was measured as a function of time by capacitively coupled voltage probes placed at different locations around the shaft. The probes were calibrated by applying known potentials to the drum substrate. As the drum was rotated, the charging potential was measured by the voltage probes. The devices were too conductive and could not be charged.

For comparison purposes, two comparative example devices were coated with a solution prepared by roll milling a polycarbonate Makrolon (2.00 grams) with methylene chloride (22.44 grams) and N,N'-diphenyl-N,N'-bis(3"-methylphenyl)-(1,1'-biphenyl)-4,4'-diamine (2.00 grams). Makrolon® is a polycarbonate resin having a molecular weight of from 50,000 to about 100,000 commercially available from Farbensabricken Bayer A. G. This solution was applied on substrate #1 and #2 by a 8 mil gap Bird applicator to form a coating which was heated from 40 to 100° C. over 30 minutes to dry the layer. These devices are insulating as evidenced by their good charging capability with very little dark decay.

EXAMPLE XV

This example illustrates the fabrication of films of different bulk resistivities by varying the amount of transport species while the ratio of the oxidizing group in the resin is held constant.

Three films of poly(arylene-ether-ketone) (PAE) with a chloromethyl group ratio of 0.464 per repeat unit of example 1, Makrolon, a polycarbonate commercially available from Farbensabricken Bayer A. G. and transport molecule N,N'-diphenyl-N,N'di(m-tolyl)-p-benzidine (TPD) were prepared. The films were coated on carbon substrates (Mystar) to insure proper contact and were prepared as follows: the resins of each of the three films were held constant at 1 g PAE and 1 g Makrolon while TPD content was varied at 1.13 g, 0.57 g, and 0.28 g for films A, B, and C, respectively. As a coating solvent, methylene chloride was added at 11.2 g resulting in solutions with solids contents of 21.8%, 18.6%, and 16.9%, respectively. The films were then applied onto the carbon substrate by using an 8-mil gap spaced bar and dried in a forced air oven where the temperature was ramped up from 40° C. to 100° C. over a duration of 30 minutes. The final dry thicknesses of the respective films were measured with a permascope as 20 mm, 18 mm, and 16 mm for films A, B, and C, which is consistent with the solids contents of the solutions.

In order to measure the bulk resistivity, the second contact on top of the films were made by sputtering ¼ inch circular gold electrodes onto the samples. These electrodes were then contacted with spring loaded indium padded probes. The currents running through the samples were measured at a bias of −10 V that was gradually stepped up in 1 V increments to +10 V. The resulting I–V plots were ohmic with bulk resistivities 4.76e9, 6.61e10, and 2.95e12 Wcm for samples A, B and C with an accuracy of about 3% that is mostly attributed to the uncertainty in the film thickness. If one assumes that the conduction mechanism is of a percolative or hopping nature, then the resistivities r should follow the $\ln(r) \sim d \sim m^{1/3}$ law where d is the distance between the TPD molecules, and m the mass, if the densities between the materials differ little. The films in this example are in acceptable agreement with this notion, i.e., the residual deviations from the linear fit in the ln(r) vs. $m^{1/3}$ plot are 5.3%,–9.5,% and 4.0%.

EXAMPLE XVI

A 1:1 by weight film of chloromethylated poly(arylene-ether-ketone) of Example 1 (CM-PAE-HT) and a transport molecule N,N'-diphenyl-N,N'di(m-tolyl)-p-benzidine (TPD) was prepared. The film was coated on carbon substrates (Mystar) by using an 8-mil gap spaced bar and dried in a forced air oven where the temperature was ramped up from 40° C. to 100° C. over a duration of 30 minutes. The final dry thicknesses of the film was 11 micrometers. In order to measure the bulk resistivity, the second contact on top of the films were made by sputtering ¼ inch circular gold electrodes onto the samples. These electrodes were then contacted with spring loaded indium padded probes.

Conductivity of the specimen films configured in plane parallel geometry were measured by AC and DC techniques. AC conductivity was measured using a combination of bridges operating under computer control to span the frequency range from 30 Hertz to 1 MegaHertz. Measurements in the range 30 Hertz and 10 kiloHertz were made using a General Radio 1689M digibridge. Measurements in the range 10 kiloHertz to 1 MegaHertz were made using a Hewlett Packard 4275A RLC bridge. DC measurements were made using a Keithley 617 Electrometer in conjunction with a Stanford Research PS 325 power supply jointly under computer control. AC conductivity typically consists of two components respectively arising from free carrier dissipation and dissipation associated with bound charge. Free carrier or "Drude" dissipation is characteristically frequency independent and is precisely the mechanism which also gives rise to DC conductivity. Dissipation due to bound charges arises from various mechanisms and is readily distinguished by characteristic frequency dependencies. In the present measurements ac conductivity data collected in the low frequency range was in fact flat and always yielded results coincident with the corresponding dc conductivities. DC measurements were made in an up-down scanning mode with a sixty second dwell time at each voltage. The DC resistivity was $3\times10^{10}$ ohm cm and the low frequency ac conductivity gave the same value. There was no hysterisis associated with these scans. The specimens were perfectly stable electrically and yielded identical results when measured after long term (15 months) storage.

EXAMPLE XVII

A molecule of the formula:

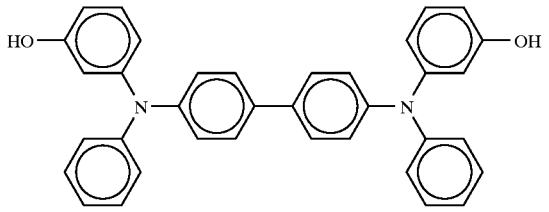

was prepared as follows:

A. Preparation of m-methoxy acetanilide:

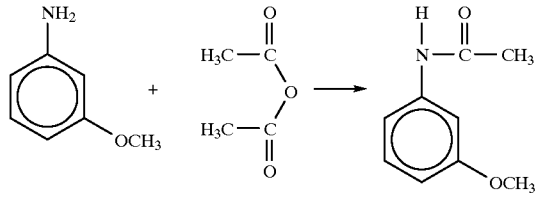

Into a 5-liter, 3-necked round bottom flask equipped with a mechanical stirrer, argon inlet equipped with a thermometer, and condenser were added 1006 grams of m-anisidine (obtained from Aldrich Chemical Co., Milwaukee, Wis.), 777.5 milliliters of glacial acetic acid, and 8 grams of zinc dust while argon was introduced into the flask. The contents of the flask were heated to 70° C., followed by removal of the heating mantle and replacement of the condenser with an addition funnel containing 777.5 milliliters of acetic anhydride. The acetic anhydride was added over 40 minutes at a rate so as to maintain a mild reflux. When addition of the acetic anhydride was complete, the addition funnel was removed and replaced with the condenser, followed by replacement of the heating mantle and heating the flask contents to reflux at a temperature of 126° C. Reflux was maintained for an additional 3 hours.

Thereafter, a 4 liter beaker was charged with 2.5 liters of deionized water and stirred intermittently as about one half (approximately 1,250 milliliters) of the contents of the round bottom flask was poured slowly into the water. The initial pour rate was slow, until the stirred water mixture formed compact solid granules. Once these seed crystals were formed, the rate of addition was increased. The resulting water slurry was filtered through a 3 liter fritted glass (coarse) funnel using a water aspirator, followed by discarding of the filtrate. The 4 liter beaker was then recharged with 2.5 liters of deionized water and the remaining contents of the round bottom flask were added to the beaker to precipitate the product, followed by pouring the contents of the beaker onto the previously filtered product (m-methoxy acetanilide). The solid collected in the filter was then washed with 1 liter of deionized water.

The crude m-methoxy acetanilide was added to a 2 gallon pail and 4 liters of deionized water (including that water necessary to wash the sides of the funnel free of the product) were transferred to the pail. The water/acetanilide mixture was then stirred and allowed to sit for 15 minutes, followed by filtration of the contents of the pail and washing of the residue with 1 liter of deionized water. The wash procedure was repeated except that the water/acetanilide mixture was allowed to sit for 30 minutes, followed by filtration and washing with 1 liter of deionized water. The fritted glass funnel containing the m-methoxy acetanilide was left connected to the water aspirator for an additional 2 hours to remove excess water.

The fritted glass funnel containing the m-methoxy acetanilide was then placed in a drying oven with aluminum foil under the funnel to catch any acetanilide which might fall from the funnel. A water aspirator was used to effect a vacuum and a drying temperature of 50° C. for 3 days was maintained. The dried m-methoxy acetanilide was then removed from the oven. The ash-gray granular solid product, which had a distinctly acetic acid odor, was placed in a polyethylene bottle. MP: 80° C.; yield: 1095 grams (81%).

B. Preparation of m-methoxy diphenylamine:

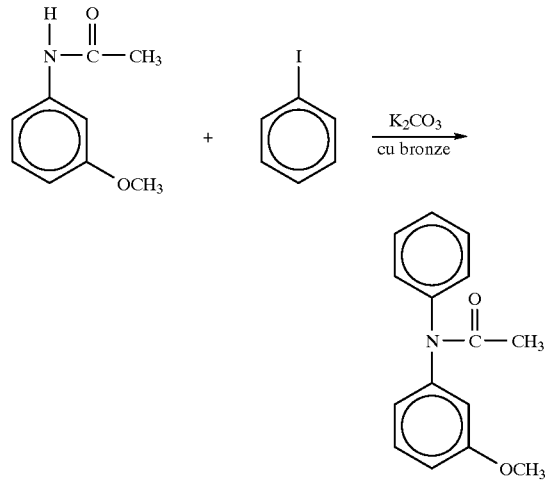

Into a 5-liter, 3-necked round bottom flask equipped with a mechanical stirrer, argon inlet equipped with a thermometer, and condenser (Dean-Stark trap) were added 990 grams of m-methoxy acetanilide, 1599.4 grams of iodobenzene (obtained from Aldrich Chemical Co., Milwaukee, Wis.), and 330 grams of copper bronze (obtained from Fisons Corp.) while argon was introduced into the flask. The contents of the flask were then heated to 70° C. With stirring, 1573 grams of potassium carbonate (Aldrich Chemical Co.) were added to the reaction flask. The reaction mixture was then heated to 180° C. The Dean-Stark trap was emptied twice during the first 6 hours of reaction. The iodobenzene from the trap was recycled back into the reaction flask. The reaction was maintained at 180° C. overnight. At a reaction time of 22 hours, the HPLC reading (flow rate: 0.5 ml/min) indicated percentages of 23 percent acetanilide (355 sec), 75 percent product (370 sec), and 13 percent iodobenzene (471 sec). The temperature was then raised to 200° C. and allowed to react an additional 6 hours, after which the HPLC reading indicated percentages of 5 percent acetanilide, 87 percent product, and 8 percent iodobenzene. The heat source was turned off and, one hour later, the mechanical stirrer was turned off, followed by allowing the reaction mixture to sit overnight. Thereafter, 1,500 milliliters of ethanol (absolute-denatured with 2-propanol) was added and the flask was heated slowly to reflux. The reaction flask contents were then filtered through a 12.5 centimeter porcelain filter using glass fiber filter pads into a 4 liter filter flask. The solids remaining in the flask were washed with two 400 milliliter portions of hot ethanol. The volume of the filtrate was then reduced.

C. Hydrolysis of m-methoxy diphenylamine:

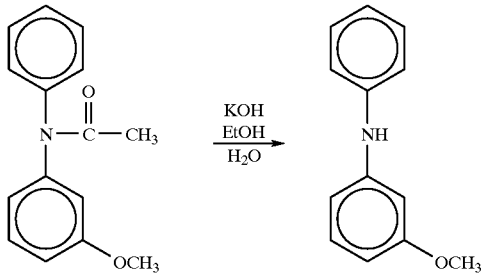

The m-methoxy diphenylamine filtrate prepared in step B was placed into a 4 liter Erlenmeyer flask containing a 3 inch magnetic stir bar. The flask was heated and stirring was initiated, followed by addition of 596 grams of potassium hydroxide flake (obtained from J. T. Baker Chemical Co.) and 532 milliliters of deionized water. Heating was continued at slow reflux for 3 hours. The hot solution was then poured into a 4 liter filter flask through a 12.5 centimeter porcelain filter funnel with fiber glass filter pads. The flask was then rinsed with ethanol, followed by stirring of the dark solution with a magnetic stirrer and addition of 1 liter of deionized water. The flask contents were allowed to stir overnight at room temperature. The amine product crystallized overnight, and the crystals were filtered using a 2 liter fritted glass filter funnel. The tan solid was washed with 500 milliliters of a 50/50 mixture of ethanol and deionized water, followed by washing with 500 milliliters of deionized water, and then further followed by washing with 500 milliliters of a 50/50 mixture of ethanol and deionized water. An aspirator was used to draw off excess liquid.

The solid thus obtained was placed in a single necked 2 liter round bottom flask while heating to melt the amine, thereby reducing volume. The amine was then cooled and allowed to solidify, followed by decanting of excess water, addition of an egg-shaped stir bar, and distillation. The distillation apparatus was heated under aspirator vacuum to remove a forerun of ethanol, water, and iodobenzene. When the reflux temperature reached 120° C., a mechanical vacuum pump was substituted for aspirator vacuum. The distillate was collected up to 160° C. at 5 millimeters as a forerun. The remaining following distillate was collected as product. Because of the relatively high melting point (80–81° C.), a steam condenser was used. The product was collected as a pale yellow liquid which solidified as a colorless solid upon cooling. Yield: 70%.

D. Preparation of m-dimethoxy tolyldiphenylbiphenyldiamine:

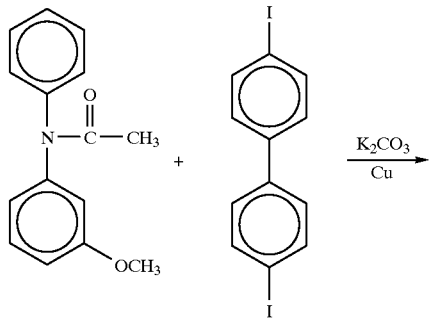

-continued

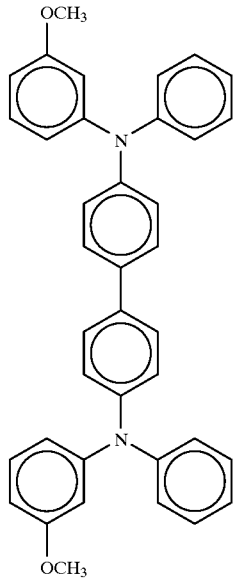

Into a 5-liter, 3-necked round bottom flask equipped with a mechanical stirrer, argon inlet equipped with a thermometer, and condenser were added 500 milliliters of Isopar® L isoparaffinic hydrocarbon (obtained from Noco, Tonawanda, N.Y.), 500 grams of m-methoxy diphenylamine, 404 grams of 4,4'-diiodobiphenyl, and 200 grams of copper bronze (obtained from Fisons Corp., Loughborough Leics, England) while argon was flowing through the apparatus at a rate of 25 milliliters per minute. The reaction vessel was then heated to 70° C., after which 552 grams of anhydrous potassium carbonate was added with stirring. The reaction vessel was then maintained at a temperature of from about 180 to about 200° C. for 24 hours. After 2 hours, a HPLC sample reading indicated percentages of 30 percent diiodobiphenyl (418 sec), 40 percent intermediate (480 sec), and 30 percent product (526 sec). After 24 hours, a HPLC sample reading indicated 0 percent diiodobiphenyl, 5 percent intermediate, and 95 percent product. The reaction mixture was then allowed to cool to 80° C., followed by addition of 1 liter of 2-propanol and stirring for 15 minutes. The reaction mixture was then allowed to sit overnight at room temperature. Thereafter, the 2-propanol layer was decanted and set aside for recovery of excess methoxy diphenylamine. Toluene (1 liter) was then added to the reaction mixture and heated to reflux. Residual 2-propanol was allowed to escape the reaction flask until the reflux vapor temperature exceeded 95° C. The hot solution was then filtered through a 15.0 centimeter porcelain filter funnel equipped with fiber glass filter pads. The filtrate was collected in a 2-liter filter flask. Several washings with toluene were carried out until the filtrate was colorless. The filtrate was a light brown color. The volume of the filtrate was reduced to about 1 liter with a rotary evaporator. Purification was then carried out by placing about 1 cup of glass wool into the bottom of a chromatography column 5 centimeters in diameter and 150 centimeters long and adding 1.5 liters of toluene to the column. A funnel was then placed on the top of the column and 1.5 kilograms of Woelm neutral alumina was added therethrough. Toluene was eluted until the liquid reached the alumina bed. Subsequently, the 1-liter toluene solution of the product was added to the column, followed by elution with toluene. Progress of the product through the column was slow (about 4 hours) and was monitored with a long wavelength UV lamp. About 5 liters of eluent was collected and toluene was removed with a rotary evaporator. To the remaining yellowish viscous oil was added 1 liter of Isopar® L and an egg shaped stir bar. The flask was placed in a heating mantle, rested on a magnetic stir plate, and heated with stirring to 150° C. The contents of the flask were blanketed with argon during this heating step at a rate of 25 milliliters per minute, and toluene vapors were permitted to escape. After 1 hour, 50 grams of Woelm neutral alumina were added to the flask and stirring was continued overnight. Subsequently, the dark alumina was filtered from the pale yellow Isopar® L solution using a 2 liter filter flask and a preheated 9.0 centimeter porcelain filter funnel. The product precipitated as a yellowish oil as the flask cooled. The resulting viscous oil was then dissolved in 1 liter of diethyl ether and allowed to stir with a magnetic stirrer overnight. The resulting fine precipitate was collected in a 600 milliliter fritted glass funnel (medium) and dried in a vacuum oven at 40° C. Yield: 70–90%; MP: 120–125° C.

E. Preparation of m-dihydroxy tolyl-diphenylbiphenyldiamine:

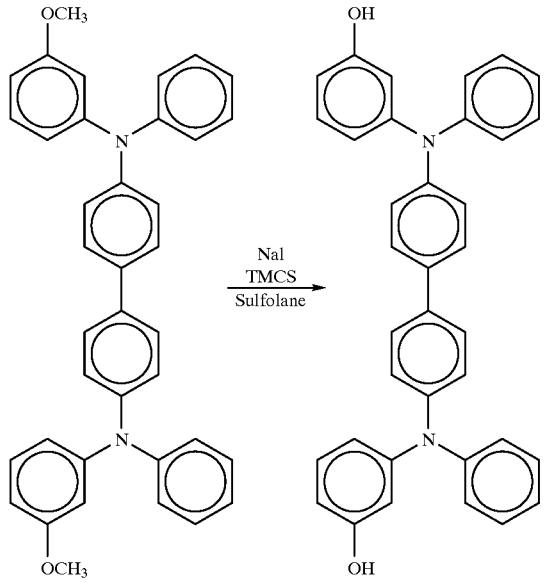

Into a -liter, 3-necked round bottom flask equipped with a mechanical stirrer, argon inlet equipped with a thermometer, and condenser were added 137.5 grams of m-dimethoxy TBD, 223.5 grams of anhydrous sodium iodide, and 500 milliliters of warm sulfolane while argon flowed through the system at a rate of 25 milliliters per minute. The contents were heated with stirring and with the condenser removed to 120° C., followed by maintaining the contents at 120° C. for 15 minutes. The contents were then allowed to cool to 70° C. The condenser and an addition funnel assembled with a Claisen adapter were added to the apparatus and the addition funnel was charged with 190.5 milliliters of trimethyl chlorosilane and sealed with a glass stopper. The trimethyl chlorosilane was added dropwise over 30 minutes, with the heating mantle on the round bottom flask adjusted to maintain a slow reflux at 60 to 65° C. Reaction was timed from the start of the addition. A 1 hour HPLC sample was taken to determine the initial water content, and indicated that the percentage of dimethoxy TBD was between 50 and 80 percent. 1 milliliter of deionized water was then added and the reaction was allowed to proceed for 6 hours. A second HPLC sample measurement indicated 50 percent diphenol (280 sec), 40 percent intermediate (365 sec), and 10 percent dimethoxy TBD (535 sec), with any side products appearing at 335 sec. Subsequently, 1 milliliter of deionized water was added and the mixture was allowed to stir overnight at 65–75° C. Thereafter, a third HPLC sample measurement indicated 90 percent diphenol, 10 percent intermediate, and 0 percent dimethoxy TBD. One milliliter of deionized water and 37.5 grams of anhydrous sodium iodide were then added to the mixture. After 4 hours, the reaction was complete with no intermediate detectable.

The contents of the reaction vessel were poured into a 3 liter Erlenmeyer flask containing 1,500 milliliters of deionized water. The product precipitated as a viscous oil. The water was decanted and the residue was dissolved in 500 milliliters of acetone heated on a steam bath. The reddish solution was then diluted with 2 liters of deionized water. The second precipitate was more rigid than the first. The water layer was cloudy because of the presence of suspended product, and the flask was heated to about 50° C. to clarify the water layer. Thereafter, the flask was cooled to room temperature and the water layer was decanted. The residue was then dissolved in 800 milliliters of toluene, followed by addition of anhydrous magnesium sulfate to adsorb retained water. The solution was filtered through a porcelain filter with filter paper and the toluene was removed with a rotary evaporator.

The remaining residue was dissolved in 500 milliliters of pyridine and transferred to a 2 liter 3 necked round bottom flask equipped with an argon inlet and a mechanical stirrer. The assembly was purged with argon and the flask was cooled in an ice bath, followed by addition of 58.5 grams of acetyl chloride dropwise with a pressure equalizing addition funnel. An immediate precipitate formed. The mixture was allowed to stir overnight. Thereafter, the reddish mixture was poured into an Erlenmeyer flask containing 2 liters of deionized water. The water layer was decanted off and the oily residue was dissolved in 500 milliliters of acetone, followed by addition of 2 liters of deionized water. The cloudy water layer was clarified by warming in a water bath. The flask was then cooled to room temperature and the water layer was decanted. The red residue was dissolved in 500 milliliters of toluene, followed by addition of anhydrous magnesium sulfate to remove retained water.

A chromatography column was prepared by placing about ½ cup of glass wool in the base of a column 3 centimeters in diameter and 100 centimeters long. The column was filled with toluene. A funnel was then placed on the top of the column and 300 grams of Florisil (60–100 mesh) was added. Sufficient elutant was removed via stopcock to lower the solvent level to the adsorbent layer. Subsequently, the toluene solution was added to the column. After the solution had entered the column, it was eluted with toluene. Progress of the product through the column was monitored with a long wavelength UV lamp. The eluent (about 2 liters) was collected and toluene was removed with a rotary evaporator. The viscous product in the collection flask was connected to a vacuum pump to remove the last traces of toluene. The vacuum dried acetate product was then removed from the flask, dried in a vacuum oven overnight, and weight. Yield: 80%.

The acetate product thus prepared (60.4 grams) was placed in a 1 liter 3-necked round bottom flask equipped with a mechanical stirrer and an argon inlet. The flask was purged with argon, followed by addition of 150 milliliters of tetrahydrofuran and stirring until the acetate dissolved. Thereafter, the mixture was diluted with 100 milliliters of ethanol. The flask was then cooled in an ice bath. Using a pressure equalizing addition funnel, a solution of 11.4 grams of potassium hydroxide flakes in 70 milliliters of deionized water was then added dropwise. After the addition, the orange-red solution was allowed to stir for 1 hour. Using a pressure equalizing funnel, a solution of 12.4 grams of glacial acetic acid in 70 milliliters of deionized water was then added dropwise. After the acid addition, 400 milliliters of deionized water was added to the flask. The resulting solid precipitate was collected on a fritted glass funnel, washed with deionized water, and dried in vacuo. The resulting dried diphenol was dissolved in 300 milliliters of diethyl ether. The reddish purple solution was stirred with a magnetic stirrer and purged with argon. Thereafter, 20 grams of Florisil was added and the solution was stirred for 2 hours. The resulting colorless solution was filtered off and the ether was removed with a rotary evaporator. To the pale yellow diphenol oil was then added 200 milliliters of acetone. After dissolution, the pale yellow solution was diluted with 300 milliliters of heptane. The acetone was slowly removed via a rotary evaporator to yield a white powder suspended in heptane. the diphenol product was filtered and dried in vacuo. Yield: 80%; MP: 113–117° C.

EXAMPLE XVIII

A polyarylene ether ketone of the formula

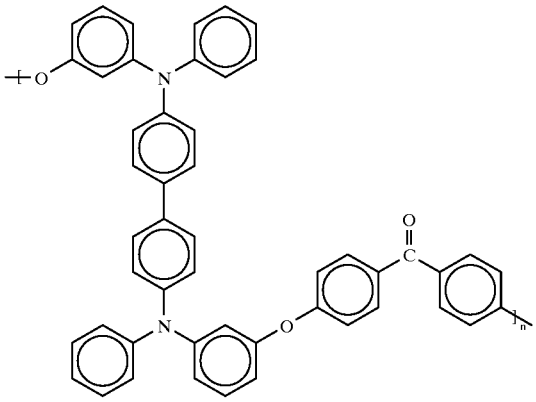

wherein n is about 128 (hereinafter referred to as poly(4-FPK-DHTBD)) was prepared as follows. A 500-milliliter, 3-neck round-bottom flask equipped with a Dean-Stark (Barrett) trap, condenser, mechanical stirrer, argon inlet, and stopper was situated in a silicone oil bath. 4,4'-Difluorobenzophenone (Aldrich 11,549-5, Aldrich Chemical Co., Milwaukee, Wis., 4.26 grams), m-dihydroxy tolyl-diphenylbiphenyldiamine (DHTBD, 10 grams), potassium carbonate (6.6 grams), anhydrous N,N-dimethylacetamide (30 milliliters), and toluene (5.2 milliliters) were added to the flask and heated to 175° C. (oil bath temperature) while the volatile toluene component was collected and removed. After 4 hours of heating at 175° C. with continuous stirring, the reaction mixture was allowed to cool to 25° C. The reaction mixture was stirred with 250 grams of methylene chloride, filtered to remove potassium carbonate and precipitated into methanol (1 gallons). The precipitate was collected by filtration, washed with 2.5 gallons of water, and then washed with 1 gallon of methanol. The polymer (poly (4-FPK-DHTBD)) was isolated in 80 percent yield after filtration and drying in vacuo. GPC analysis was as follows: $M_n$ 90,000, $M_w$ 235,000. As a result of the stoichiometries used in the reaction, it is believed that this polymer had end groups derived from DHTBD groups. The polymer dissolved in methylene chloride at 10 percent solids was added to methanol (1 gallon) using a Waring blender to reprecipitate the polymer. The polymer was then isolated by filtration and vacuum dried.

EXAMPLE XIX

A polyarylene ether of the formula

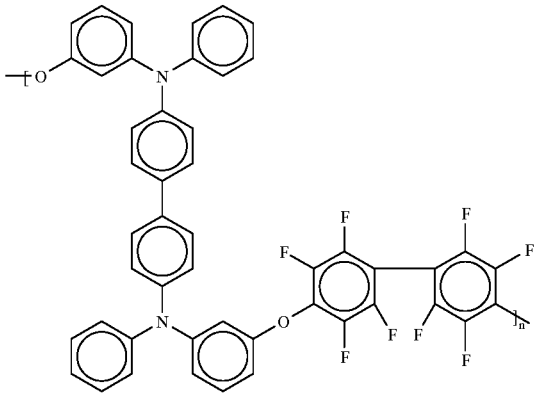

wherein n is about 120 (hereinafter referred to as poly(4-DFBP-DHTBD)) was prepared as follows. A 500-milliliter, 3-neck round-bottom flask equipped with a Dean-Stark (Barrett) trap, condenser, mechanical stirrer, argon inlet, and stopper was situated in a silicone oil bath. 4,4'-Decafluorobiphenyl (Aldrich D22-7, Aldrich Chemical Co., Milwaukee, Wis., 5 grams), m-dihydroxy tolyl-diphenylbiphenyldiamine (DHTBD, 5.2 grams), potassium carbonate (12.3 grams), and anhydrous N,N-dimethylacetamide (75 milliliters) were added to the flask and heated at 150° C. (oil bath temperature) for 4 hours with continuous stirring. The reaction mixture was then allowed to cool to 25° C. The reaction mixture was stirred with 250 grams of tetrahydrofuran, filtered to remove potassium carbonate, concentrated using a rotary evaporator, and then precipitated into methanol (1 gallons). The precipitate was collected by filtration, washed with 2.5 gallons of water, and then washed with 1 gallon of methanol. The polymer (poly (4-FPK-DHTBD)) was isolated in 80 percent yield after filtration and drying in vacuo. As a result of the stoichiometries used in the reaction, it is believed that this polymer had end groups derived from DHTBD groups. The polymer dissolved in tetrahydrofuran at 10 percent solids was added to methanol (1 gallon) using a Waring blender to reprecipitate the polymer. The polymer was then isolated by filtration and vacuum dried.

EXAMPLE XX

Preparation of Poly(arylene ether amine sulfone)

A poly(arylene ether amine sulfone) of the formula

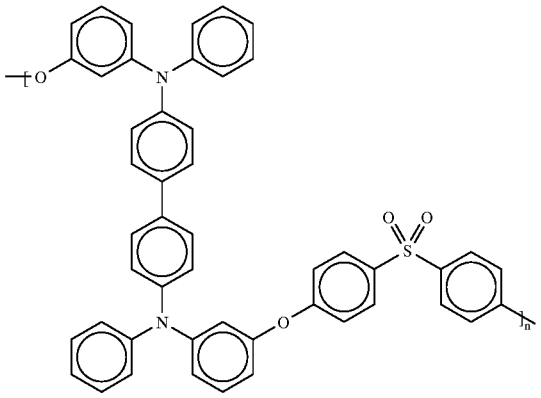

wherein n is about 128 (hereinafter referred to as poly(4-DFPS-DHTBD)) was prepared as follows. A 500-milliliter, 3-neck round-bottom flask equipped with a Dean-Stark (Barrett) trap, condenser, mechanical stirrer, argon inlet, and stopper was situated in a silicone oil bath. 4,4'-Difluorobenzosulfone (Aldrich Chemical Co., Milwaukee, Wis., 4.92 grams, 0.0193 mole), m-dihydroxy tolyldiphenylbiphenyldiamine (DHTBD, 10 grams), potassium carbonate (7.0 grams), anhydrous N,N-dimethylacetamide (50 milliliters), and toluene (15 milliliters) were added to the flask and heated to 175° C. (oil bath temperature) while the volatile toluene component was collected and removed. After 4 hours of heating at 175° C. with continuous stirring, the reaction mixture was allowed to cool to 25° C. The reaction mixture was stirred with 250 grams of methylene chloride, filtered to remove potassium carbonate and precipitated into methanol (1 gallons). The precipitate was collected by filtration, washed with 2.5 gallons of water, and then washed with 1 gallon of methanol. The polymer (poly (4-DPS-DHTBD)) was isolated in 80 percent yield after filtration and drying in vacuo. GPC analysis was as follows: $M_n$ 90,000, $M_w$ 235,000. As a result of the stoichiometries used in the reaction, it is believed that this polymer had end groups derived from DHTBD groups. The polymer dissolved in methylene chloride at 10 percent solids was added to methanol (1 gallon) using a Waring blender to reprecipitate the polymer. The polymer was then isolated by filtration and vacuum dried.

Similarly, a low molecular weight poly(4-DPS-DHTBD) was made by heating 4 -chlorophenylsulfone (5.55 g, 0.0193 mole), 10 grams of DHTBD, 50 mL of N,N-dimethylacetamide, 15 mL of toluene, 7 g of potassium carbonate for 4 hours at 175° C.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A tunable conductivity coating composition selected from the group consisting of a first composition comprising a polymer containing halomethylated aromatic groups and a charge transporting material selected from the group consisting of at least one charge transport monomer containing arylamine groups, at least one charge transport polymer containing aryl amine units in the main polymer chain, and mixtures of thereof, a second composition comprising at least one monomer containing a halomethylated aromatic group, at least one charge transport monomer containing arylamine groups and a polymer binder, and a third composition comprising at least one monomer containing a halomethylated aromatic group and at least one charge transport polymer with arylamine units in the main polymer chain.

2. A tunable conductive coating in accordance with claim 1 wherein the monomer containing a halomethylated group is represented by the formula:

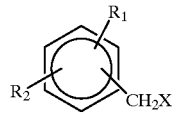

wherein $R_1$ and $R_2$ are selected from the group consisting of arylene, alkylene or arylenealkyl groups containing from 1 to 20 carbon atoms in the alkylene and arylene group, and X is selected from the group consisting of Cl, Br and l.

3. A tunable conductive coating in accordance with claim 1 wherein the polymer containing arylamine units is represented by the formula:

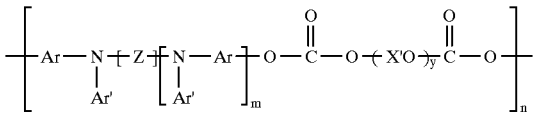

wherein:

m is 0 or 1, n is between about 5 and about 5000,

Z is selected from the group consisting of:

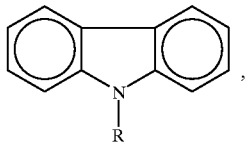

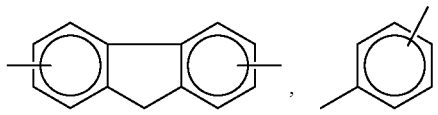

-continued

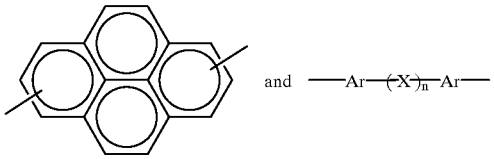

n is 0 or 1,

Ar is selected from the group consisting of:

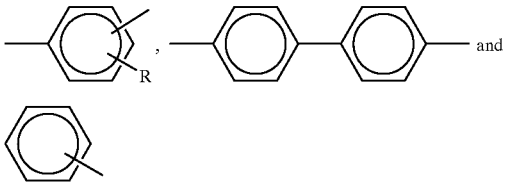

R is an alkyl radical selected from the group consisting of alkyl and iso-alkyl groups containing 2 to 10 carbon atoms, Ar' is selected from the group consisting of:

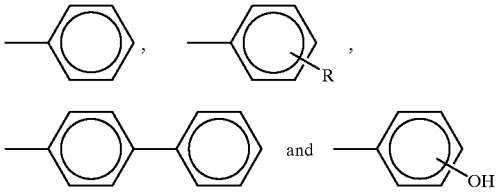

X is selected from the group consisting of:

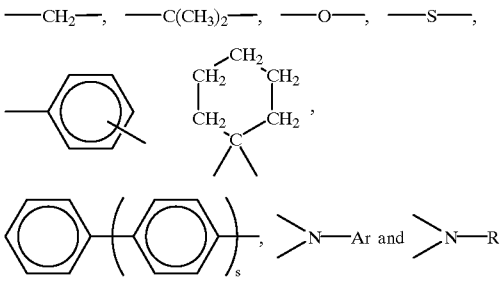

s is 0, 1 or 2,

X' is an alkylene radical selected from the group consisting of alkylene and iso-alkylene groups containing 2 to 10 carbon atoms, and Y is 1, 2 or 3.

4. A tunable conductive coating in accordance with claim 1 wherein the monomer containing arylamine groups is represented by the formula:

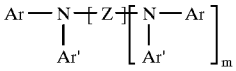

wherein m is 0 or 1,

Z is selected from the group consisting of:

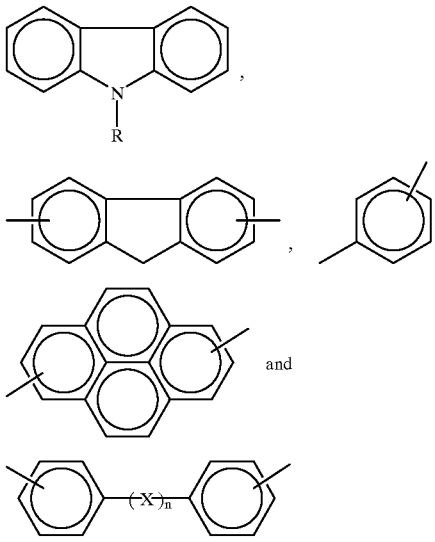

n is 0 or 1,

Ar is selected from the group consisting of:

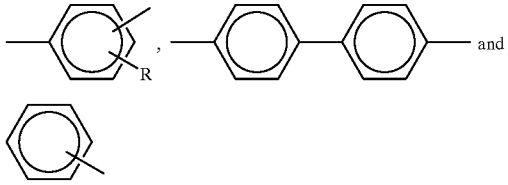

R is selected from the group consisting of $—CH_3$, $—C_2H_5$, $—C_3H_7$, and $—C_4H_9$, Ar' is selected from the group consisting of:

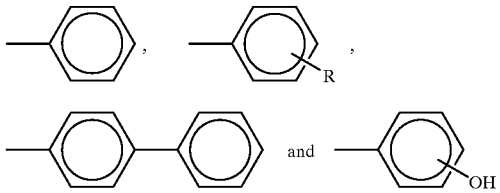

X is selected from the group consisting of:

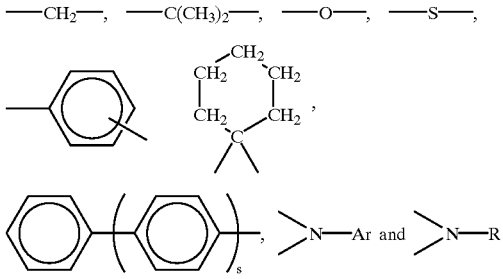

s is 0, 1 or 2.

5. A tunable conductive coating in accordance with claim 1 wherein the polymer containing halomethylated aromatic groups is represented by the formula:

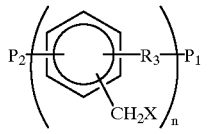

wherein $P_1$ and $P_2$ are polymers, $R_3$ is selected from the group consisting of substituted or unsubstituted arylene, alkylene or arylene alkyl containing from 1 to 20 carbon atoms in the arylene group, X is selected from the group consisting of Cl, Br and l, and n is >1.

6. A tunable conductive coating in accordance with claim 5 wherein the polymer containing halomethylated groups is chloromethylated poly(ether sulfone) represented by the formula:

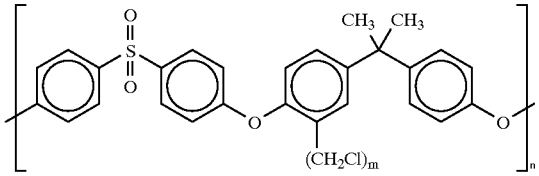

wherein n is >1 and 0<m<1.

7. A tunable conductive coating in accordance with claim 5 wherein the polymer containing halomethylated groups is chloromethylated polycarbonate represented by the formula:

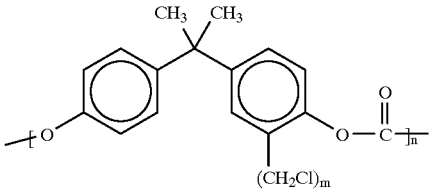

wherein n is >1 and 0<m<1.

8. A tunable conductive coating in accordance with claim 5 wherein the polymer containing halomethylated groups is a chloromethylated, fluorinated poly(arylene ether) represented by the formula:

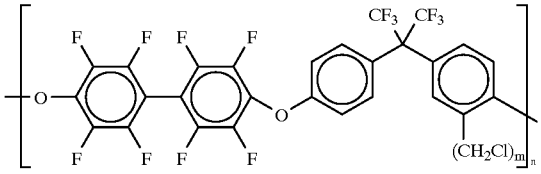

wherein n is >1 and 0<m<1.

9. A tunable conductive coating in accordance with claim 5 wherein the polymer containing halomethylated groups is chloromethylated poly(benzophenone-bisfluoreneone) represented by the formula:

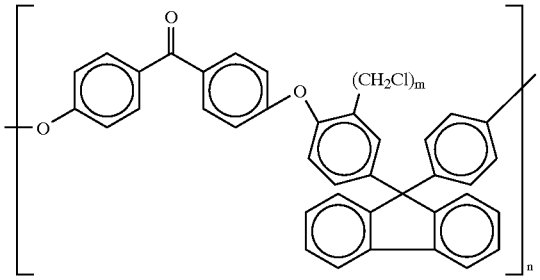

wherein:

n is >1 and 0<m<1.

10. A tunable conductive coating in accordance with claim 5 wherein the polymer containing halomethylated groups is poly(arylene ether ketone) is represented by the formula:

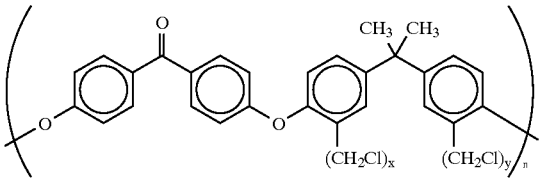

wherein

0<x<1 and 0<y<1.

11. A tunable conductive coating in accordance with claim 1 wherein the ratio of the monomer containing halomethylated aromatic group or polymer containing halomethylated aromatic group to the monomer containing arylamine group or polymer containing arylamine unit is from about 0.01:99.9 to about 99.9:0.01 by weight.

12. A tunable conductive coating in accordance with claim 1 wherein the ratio of the monomer containing halomethylated aromatic group plus the monomer containing arylamine group to the polymer binder is from about 10:90 to about 90:10 by weight.

13. A tunable conductive coating in accordance with claim 1 wherein the coating has conductivity of between about $10^{-12}$ and about 1 S/cm.

14. A process for preparing tunable conductive coating comprising:

providing a substrate, preparing a coating solution of a solvent admixed with a composition selected from the group consisting of a first composition comprising a polymer containing halomethylated aromatic groups, and a charge transporting material selected from the group consisting of at least one charge transport monomer containing arylamine groups, at least one charge transport polymer containing arylamine units in the main polymer chain, and mixtures thereof, and a second composition comprising at least one monomer containing a halomethylated aromatic group, at least one charge transport monomer containing arylamine groups and a polymer binder, and a third composition comprising:

at least one monomer containing a halomethylated aromatic group, and at least one charge transport polymer with arylamine units in the main polymer chain, applying the coating solution on the substrate to form a coating, and drying the coating to forming an electrically conductive layer.

15. A process for preparing tunable conductive coating according to claim 14 solids concentration of the coating solution is from about 0.1 to about 50 weight percent, based on the total weight of the coating solution.

16. A process for preparing tunable conductive coating according to claim 14 wherein the coating has conductivity of between about $10^{-12}$ and about 1 S/cm after drying.

17. A process for preparing tunable conductive coating according to claim 14 wherein the ratio of the monomer containing halomethylated aromatic group or polymer containing halomethylated aromatic group to the monomer containing arylamine group or polymer containing arylamine unit is from about 0.01:99.9 to about 99.9:0.01 by weight.

18. A process for preparing tunable conductive coating according to claim 14 wherein the ratio of the monomer containing halomethylated aromatic group plus the monomer containing arylamine group to the polymer binder is from about 10:90 to about 90:10 by weight.

* * * * *